US011628107B1

(12) United States Patent
Reznikov

(10) Patent No.: US 11,628,107 B1
(45) Date of Patent: Apr. 18, 2023

(54) LEG ASSEMBLY CONFIGURED FOR USE WITH A WHEELCHAIR AND A COMBINATION WHEELCHAIR AND LEG ASSEMBLY

(71) Applicant: Alexander Reznikov, Austin, TX (US)

(72) Inventor: Alexander Reznikov, Austin, TX (US)

( * ) Notice: Subject to any disclaimer, the term of this patent is extended or adjusted under 35 U.S.C. 154(b) by 569 days.

(21) Appl. No.: 16/821,084

(22) Filed: Mar. 17, 2020

(51) Int. Cl.
*A61G 5/12* (2006.01)
*A61G 5/08* (2006.01)
*A61G 5/10* (2006.01)

(52) U.S. Cl.
CPC ..... *A61G 5/127* (2016.11); *A61G 5/08* (2013.01); *A61G 5/1091* (2016.11)

(58) Field of Classification Search
CPC ..... A61G 5/127; A61G 5/1091; A61G 5/08; A61G 5/128
See application file for complete search history.

(56) References Cited

U.S. PATENT DOCUMENTS 3,618,968 A * 11/1971 Greer ..... A61G 5/006 280/47.11
4,486,048 A * 12/1984 Meyer ..... A61G 5/128 297/DIG. 4
4,635,999 A * 1/1987 Simpson ..... B64D 11/06 297/423.35
5,033,793 A * 7/1991 Quintile ..... A61G 5/1054 74/109
5,145,197 A 9/1992 Gatti
5,328,247 A * 7/1994 Lovins ..... A61G 5/128 297/423.36
6,499,756 B2 12/2002 Amirola
7,243,938 B2 7/2007 Stamps
7,360,840 B2 * 4/2008 Barlow ..... A61G 5/127 297/423.26
7,367,578 B2 5/2008 Jansen
7,487,989 B2 2/2009 Crosby, II
2006/0012148 A1 1/2006 Melgarejo
2016/0331609 A1 * 11/2016 Cheng ..... A61G 5/128

* cited by examiner

*Primary Examiner* — Kevin Hurley
*Assistant Examiner* — Harold Eric Pahlck, III
(74) *Attorney, Agent, or Firm* — Garcia-Zamor Intellectual Property Law, LLC; Ruy Garcia-Zamor

(57) ABSTRACT

A leg assembly configured to be used with a wheelchair that may be constructed of various mechanical and manual powered components to reduce the cost and unreliability of motor, electric, or otherwise non-manual powered adjustable wheelchairs. A combination wheelchair and leg assembly that may be constructed of various mechanical and manual powered components. The leg assembly disclosed may alternatively be motor powered.

20 Claims, 27 Drawing Sheets

LEG ASSEMBLY CONFIGURED FOR USE WITH A WHEELCHAIR AND A COMBINATION WHEELCHAIR AND LEG ASSEMBLY

BACKGROUND

The present invention is generally directed to medical equipment and, more specifically, to wheel chair attachments and alternatives. More specifically still, the invention is directed toward a leg assembly configured for use with a wheelchair.

Typical wheelchairs employed in the healthcare industry include static leg rests and foot rests that are generally a one-size-fits all approach to supporting legs and feet during the healing process. These wheelchairs have leg rests that are poorly supported. More specialized wheelchairs for particular injuries or longer term care may also suffer from this problem. Some motorized wheelchairs have tremendous limitations for time and distance of use. This can lead to frequent fueling and/or recharging. These more specialized wheelchairs can be quite expensive and still are miserable for patients to use for an extended basis.

It may be advantageous to provide a leg assembly that: may be retrofitted to a standard manual wheelchair, may increase comfort, may be more efficient to manufacture, may be manufactured with a wheelchair, and/or which may increase patient comfort.

SUMMARY

Briefly speaking, one embodiment of the present invention is directed to a leg assembly configured to be used with a wheelchair. The wheelchair may have first and second wheel support beams. The leg assembly may comprise a leg support post. The leg support post may further comprise an outer tube having a proximal outer tube end and a distal outer tube end. The leg support post may also comprise an inner tube that may be configured to slide within the outer tube and may have a distal inner tube end. The inner tube may protrude from the distal outer tube end such that the distal inner tube end may not be contained within the outer tube. The leg support post may further comprise a foot rest secured to the inner tube proximate the distal inner tube end. The leg assembly may further comprise a mounting assembly configured to be attachable to one of the first and the second wheel support beams of the wheel chair. The leg support post may be connected to the mounting assembly such that the leg support may be rotated therearound between a first, retracted position in which the wheelchair user's leg is meant to be supported in a bent position and a second, extended position in which the wheelchair user's leg is meant to be supported in a less bent position. Alternatively, the leg support post may be connected to the mounting assembly which may be articulated to accommodate natural anatomical support and can be adjusted as needed for each person. The mounting assembly may also be configured such that when the leg support post may be moved from the first, retracted position toward the second, extended position the inner tube can slide within the outer tube such that the distal inner tube end moves further away from the distal outer tube end. When the leg support post may move from the first, retracted position toward the second, extended position, the leg support post may not pivot about the proximal outer tube end which results in the proximal outer tube end moving through an arcuate path about the mounting assembly.

In a separate embodiment, the present invention is directed to a leg assembly configured to be used with a wheelchair. The wheelchair may have first and second wheel support beams. The leg assembly may comprise a leg support post. The mounting assembly may be configured such that when connected to the wheelchair, the mounting assembly can be located under a seat thereof and between the first and second wheel support beams. The leg support post may be connected to the mounting assembly via a first linkage and a second linkage. The first linkage and the second linkage can engage the mounting assembly at a different height when the mounting assembly is attached to the wheelchair. The leg support post may also be connected to the mounting assembly via a third linkage. The third linkage can engage the mounting assembly at a different height from the first linkage and the second linkage when the mounting assembly is attached to the wheelchair. The first linkage and the second linkage may extend between the outer tube and the mounting assembly.

In a separate embodiment, the present invention is directed to a leg assembly configured to be used with a wheelchair. The wheelchair may have first and second wheel support beams. The leg assembly may comprise a leg support post. An outer tube may define a slot therein. A third linkage may have a third linkage tube end and a third linkage frame end. The third linkage tube end can be secured to a portion of the inner tube accessible via the slot such that the third linkage tube end and the inner tube can move relative to the outer tube. The third linkage frame end may be connected to the mounting assembly. The first linkage, the second linkage, and the third linkage may be configured such that when the leg support post is moved from the first, retracted position toward the second, extended position the third linkage drives the inner tube outwardly away from the outer tube.

In a separate embodiment, the present invention is directed to a leg assembly configured to be used with a wheelchair. The wheelchair may have first and second wheel support beams. The leg assembly may comprise a leg support post. Further a calf cushion may be disposed on the outer tube such that the wheelchair user's leg is aligned over the leg support post while resting on the calf cushion. A foot rest can be adjustably positioned via a joint proximate the distal inner tube end to allow an angle and a cant of the foot rest to be adjusted relative to the leg support post. The leg support post may be configured to provide a biasing force between the outer tube and the inner tube to provide a lift assistance to the wheelchair user when moving the leg support post from the first, retracted position toward the second, extended position. An elastic member may be disposed within the outer tube and positioned between the outer tube and the inner tube. The elastic member may provide the biasing force onto the inner tube.

In a separate embodiment, the present invention is directed to a leg assembly configured to be used with a wheelchair. The wheelchair may have first and second wheel support beams. The leg assembly may comprise a leg support post. The position of the leg support post relative to the mounting assembly may be detachably fixed via a pin lock mechanism. The pin lock mechanism may comprise a rounded bar having a plurality of holes and a pin fixed to the pin lock mechanism. One of the plurality of holes of the round bar may be biased into engagement with the pin by a plate elastic member extending opposite the pin. The position in which the leg support post may be secured relative to the mounting assembly can depend on which of the plurality of holes the pin engages. A lever may be used to manually disengage the rounded bar from the pin and against the plate elastic member to assist in moving the leg support post. The leg assembly may be mechanical and free of electrical components, motors, and non-manual powered devices which are used to move the leg support post.

In another aspect, the present invention is directed to a wheelchair having leg supports that can rotate from a first position, in which the leg supports are positioned generally under the seat of the wheelchair into a second position, in which the leg supports are positioned in front of the chair to support a user's legs in a bent configuration. This rotation may occur by having the leg supports rotate about a portion of the wheelchairs frame or about a wheel support post.

In another aspect, the present invention is directed to a wheelchair having leg supports that extend from a first position in which the user's legs are bent as if sitting in a chair outwardly into a second position in which the user's legs are generally straight. It is preferred, but not necessary, that the leg supports elongate during the pivoting from the first position into the second position to provide better a ergonomic fit for the user.

In another aspect, the present invention is directed to a wheelchair having multifunctional leg supports which may be: (1) rotated under the seat of the wheelchair to store them out of the way; (2) pivoted outwardly so that a user's legs can be supported in either a typical seated position or in a position in which the legs are generally straight; (3) operated solely via mechanical linkages and/or using elastic members (such as springs or hydraulics) without incorporating any electronic motors, electronic components, or engines.

In another aspect, the present invention is directed to a leg assembly configured to be used with a wheelchair. The leg support post may further comprise an outer tube having a proximal outer tube end and a distal outer tube end. The leg support post may also comprise an inner tube that may be configured to slide within the outer tube and may have a distal inner tube end. The leg assembly may further comprise a mounting assembly configured to be attachable to one of the first and the second wheel support beams of the wheel chair. The leg support post may be connected to the mounting assembly such that the leg support may be rotated therearound between a first, retracted position in which the wheelchair user's leg is meant to be supported in a bent position and a second, extended position in which the wheelchair user's leg is meant to be supported in a less bent position.

In another aspect, the present invention is directed to a leg assembly configured to be used with a wheelchair. The leg support post may further comprise an outer tube having a proximal outer tube end and a distal outer tube end. The leg support post may also comprise an inner tube that may be configured to slide within the outer tube and may have a distal inner tube end. The leg assembly may further comprise a mounting assembly configured to be attachable to one of the first and the second wheel support beams of the wheel chair. The leg support post may be connected to the mounting assembly such that the leg support may be rotated therearound between a first, retracted position in which the wheelchair user's leg is meant to be supported in a bent position and a second, extended position in which the wheelchair user's leg is meant to be supported in a less bent position. The mounting assembly may also be configured such that when the leg support post may be moved from the first, retracted position toward the second, extended position the inner tube can slide within the outer tube such that the distal inner tube end moves further away from the distal outer tube end.

In another aspect, the present invention is directed to a leg assembly configured to be used with a wheelchair. The leg support post may further comprise an outer tube having a proximal outer tube end and a distal outer tube end. The leg support post may also comprise an inner tube that may be configured to slide within the outer tube and may have a distal inner tube end. The leg assembly may further comprise a mounting assembly configured to be attachable to one of the first and the second wheel support beams of the wheel chair. The leg support post may be connected to the mounting assembly such that the leg support may be rotated therearound between a first, retracted position in which the wheelchair user's leg is meant to be supported in a bent position and a second, extended position in which the wheelchair user's leg is meant to be supported in a less bent position. When the leg support post may move from the first, retracted position toward the second, extended position, the leg support post may not pivot about the proximal outer tube end which results in the proximal outer tube end moving through an arcuate path about the mounting assembly.

In another aspect, the present invention is directed to a leg assembly configured to be used with a wheelchair. The leg support post may further comprise an outer tube having a proximal outer tube end and a distal outer tube end. The leg support post may also comprise an inner tube that may be configured to slide within the outer tube during adjustment of the angle of the leg support versus the wheelchair seat while a user is sitting in the chair.

In another aspect, the present invention is directed to a leg assembly configured to be used with a wheelchair. The leg support post may further comprise an outer tube having a proximal outer tube end and a distal outer tube end. The leg support having a calf cushion that is positioned such that the leg support provides direct upward support on a central portion of the cushion such that use of the leg support does not apply a twisting force onto the inner and outer tubes of the leg assembly.

In another aspect, the present invention is directed to an H-frame member which can be secured to a wheelchair to provide secure and stable mounting for a leg support. The H-frame members are preferably configured so that a separate H-frame member can be used for each leg support. When additional support is required, a retractable or disengageable bar can be inserted into proximate ends of adjacent H-frame members so that they become a consistent brace from one front side of the wheelchair to another.

In another aspect, the present invention is directed to a wheelchair having multifunctional leg supports which may be pivoted outwardly so that a user's legs can be supported in either a typical seated position or in a position in which the legs are generally straight. The leg supports preferably include a lift assistance device (e.g., a biasing member, a spring, a piston, or the like) which reduces the amount of force needed by a user to move the leg supports into the extended position. The wheelchair being operated solely via mechanical linkages and/or using elastic members (such as springs or hydraulics) without incorporating any electronic motors, electronic components, or engines.

In another aspect, the present invention is directed to a wheelchair having multifunctional leg supports which may be pivoted outwardly so that a user's legs can be supported in either a typical seated position or in a position in which the legs are generally straight. The leg supports preferably include a lift assistance device (e.g., a biasing member, a spring, a piston, or the like) which reduces the amount of force needed by a user to move the leg supports and the user's associated leg(s) into the extended position to preferably less than ten pounds. The wheelchair is preferably operated solely via mechanical linkages and/or using elastic members (such as springs or hydraulics) without incorporating any electronic motors, electronic components, or engines.

In another aspect, the present invention is directed to a wheelchair having multifunctional leg supports which may be pivoted outwardly so that a user's legs can be supported in either a typical seated position or in a position in which the legs are generally straight. The leg supports preferably include a lift assistance device (e.g., a biasing member, a spring, a piston, or the like) which reduces the amount of force needed by a user to move the leg supports and the user's associated leg(s) into the extended position to preferably less than five pounds. The wheelchair is preferably operated solely via mechanical linkages and/or using elastic members (such as springs or hydraulics) without incorporating any electronic motors, electronic components, or engines.

In another aspect, the present invention is directed to a wheelchair having multifunctional leg supports which may be pivoted outwardly so that a user's legs can be supported in either a typical seated position or in a position in which the legs are generally straight. The leg supports preferably include a lift assistance device (e.g., a biasing member, a spring, a piston, or the like) which reduces the amount of force needed by a user to move the leg supports and the user's associated leg(s) into the extended position to preferably less than three pounds. The wheelchair is preferably operated solely via mechanical linkages and/or using elastic members (such as springs or hydraulics) without incorporating any electronic motors, electronic components, or engines.

In another aspect, the present invention is directed to a wheelchair having multifunctional leg supports which may be pivoted outwardly so that a user's legs can be supported in either a typical seated position or in a position in which the legs are generally straight. The leg supports preferably include a lift assistance device (e.g., a biasing member, a spring, a piston, or the like) which reduces the amount of force needed by a user to move the leg supports and the user's associated leg(s) into the extended position to preferably less than five pounds. The force is preferably applied by the manual operation of a lever. The wheelchair may include a handle position at a vertical height which is one of (1) overlapping with a user's legs whiles sitting in the chair; and (2) higher than the user's legs prior to applying force. The wheelchair is preferably operated solely via mechanical linkages and/or using elastic members (such as springs or hydraulics) without incorporating any electronic motors, electronic components, or engines.

BRIEF DESCRIPTION OF THE DRAWINGS

The foregoing summary, as well as the following detailed description of the preferred embodiments of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

FIG. 5 is a side cross-sectional view of a leg assembly 100 in the preferred embodiment comprising a leg support post 108 shown in a first, retracted position 140. The leg support post 108 comprises an outer tube 110 configured to partially enclosing an inner tube 112. The outer tube 110 has a distal outer tube end 114 which is proximate a distal inner tube end 118 of the inner tube 112. The outer tube 110 has a proximal outer tube end 114 which contains an elastic member 150 in the space not enclosing the inner tube 112. This figure illustrates the compression of the elastic member 150 when the leg support post 108 is in the first, retracted position 140. Those of ordinary skill in the art will appreciate from this disclosure that the elastic member 150 can be omitted entirely or replaced with another biasing element without departing from the scope of the present invention. This figure also illustrates the inner tube 112 being connected at the distal inner tube end 118 to a foot rest 120 via a joint 146. The joint 146 comprises a first bolt 147 connecting the joint 146 to the inner tube 112. The joint 146 also comprises a second bolt 148 connecting the joint 146 to the foot rest 120. The calf cushion 144 further comprises pad screws 210 that may be used to adjust the calf cushion 144 to a desired height on the outer tube 110 and a pad adjustment plate 212 for the calf cushion 144 to be affixed to.

DETAILED DESCRIPTION OF THE PREFERRED EMBODIMENT

Figure 1:
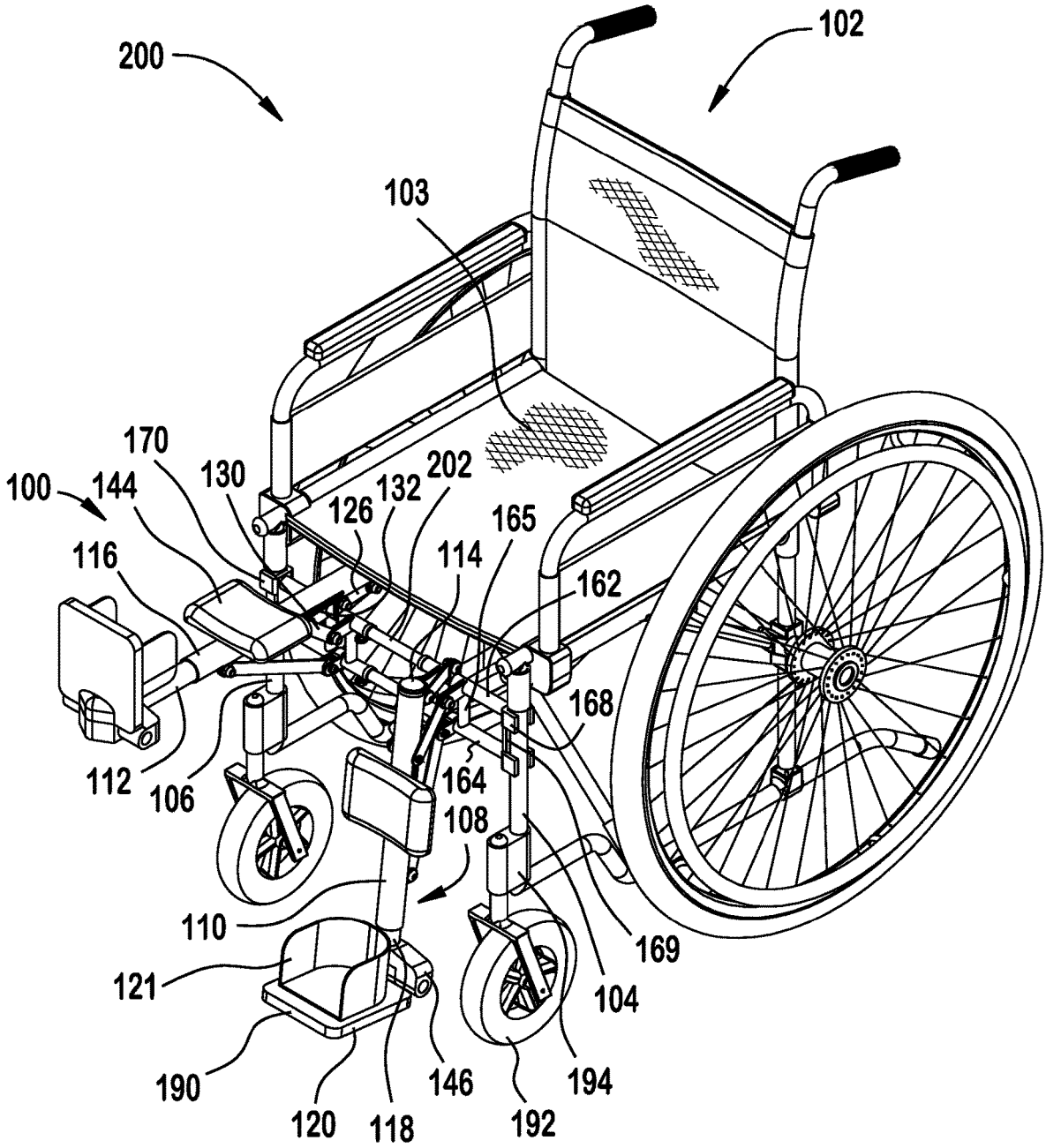
FIG. 1 is a front perspective view of a leg assembly 100 in a preferred embodiment shown in use with a wheelchair 102. The wheelchair 102 has a first wheel support beam 104 and a second wheel support beam 106. The wheelchair also has wheel 192 and a castor 194 connecting the wheel to the first and second wheel support beams 104, 106. The leg assembly 100 is configured to attach to the wheelchair 102 via a mounting assembly 122. The mounting assembly 122 comprises an H-frame 160 and spans a gap 166 formed between the first wheel support beam 104 and the second wheel support beam 106. The H-frame 160 further comprises an upper horizontal bar 162 and a lower horizontal bar 164. The upper horizontal bar 162 and the lower horizontal bar 164 are connected and separated at corresponding distal ends by a first mounting bracket 168 and a second mounting bracket 170. The first mounting bracket 168 affixes the leg assembly 100 to the first wheel support beam 102. The second mounting bracket 170 affixes the leg assembly 100 to the second wheel support beam 104. Those of ordinary skill in the art will appreciate from this disclosure that the mounting brackets can be replaced by a manufacturers mounting system and/or can be used in conjunction with a manufacturer's mounting system as a reinforcement without departing from the scope of the present invention.

Certain terminology is used in the following description for convenience only and is not limiting. The words "upper," "lower," "top" and "bottom" designate the directions as they appear in the drawings. The words "outer" and "inner" refer to directions away from and toward, respectively, the geometric center of the leg assembly. "Horizontal" and "vertical" refers to axial directions according to geometric horizontal and vertical axis of the drawing. Additionally, the words "a" and "one" are defined as including one or more of the referenced item as is commonly understood in US claim construction, unless specifically stated otherwise. The language "at least one of 'A', 'B', and 'C'," as used in the claims and/or in corresponding portions of the specification, means "any group having at least one 'A'; or any group having at least one 'B'; or any group having at least one 'C'; —and does require that a group have at least one of each of 'A', 'B', and 'C'." The terminology includes the words above specifically mentioned, derivatives thereof, and words of similar import.

Referring to FIGS. 1-24, wherein like numerals indicate like elements throughout, there is shown the preferred embodiment of a leg assembly 100 configured to be used with a wheelchair 102 (powered (e.g., electric) or unpowered). Additionally, the leg assembly 100 can be used with any seating device regardless of whether such seating device has no, a basic, or a complex rehabilitation configuration. The present invention can be retrofitted to a wheelchair or be manufactured therewith. A leg assembly 100 is understood to be for supporting and assisting in the movement of the leg of the user of a wheelchair 102. The leg assembly 100 may take many approximate shapes and sizes, and the shape of the preferred embodiment is not intended to limit any other embodiments. While the term "leg assembly" is used herein, it is not meant to be limiting. Those of ordinary skill in the art will appreciate from this disclosure that the invention may be used to support and mechanically assist the leg, the foot, or the ankle of the user of a wheelchair, and any other person or object, without exceeding the scope of this disclosure.

The components of the mounting assembly 122 are preferably made of strong, durable material such as stainless steel. However, those of ordinary skill in the art will appreciate from this disclosure that any suitable materials can be used without departing from the scope of the present invention. For example, aluminum, suitable alloys, polymers, or the like may be used without departing from the scope of the present invention. It is understood that the padding of the calf cushion 144 may incorporate any suitable padded, cushioned, or otherwise shock absorbent and comfortable material without departing from the scope of the present invention. For example, foam, rubber, or the like may be used without departing from the scope of the present invention.

Referring to FIG. 1, the preferred embodiment of the leg assembly 100 may be seen in use with a wheelchair 102. This may also be viewed as an additional preferred embodiment of a combination wheelchair and leg assembly 200. The leg assembly 100 may be configured for use with a wheelchair 102. The wheelchair may have a first wheel support beam 104 and a second wheel support beam 106. The wheelchair may also comprise a seat 103. The leg assembly 100 may comprise a leg support post 108 and a mounting assembly 122.

Figure 2:
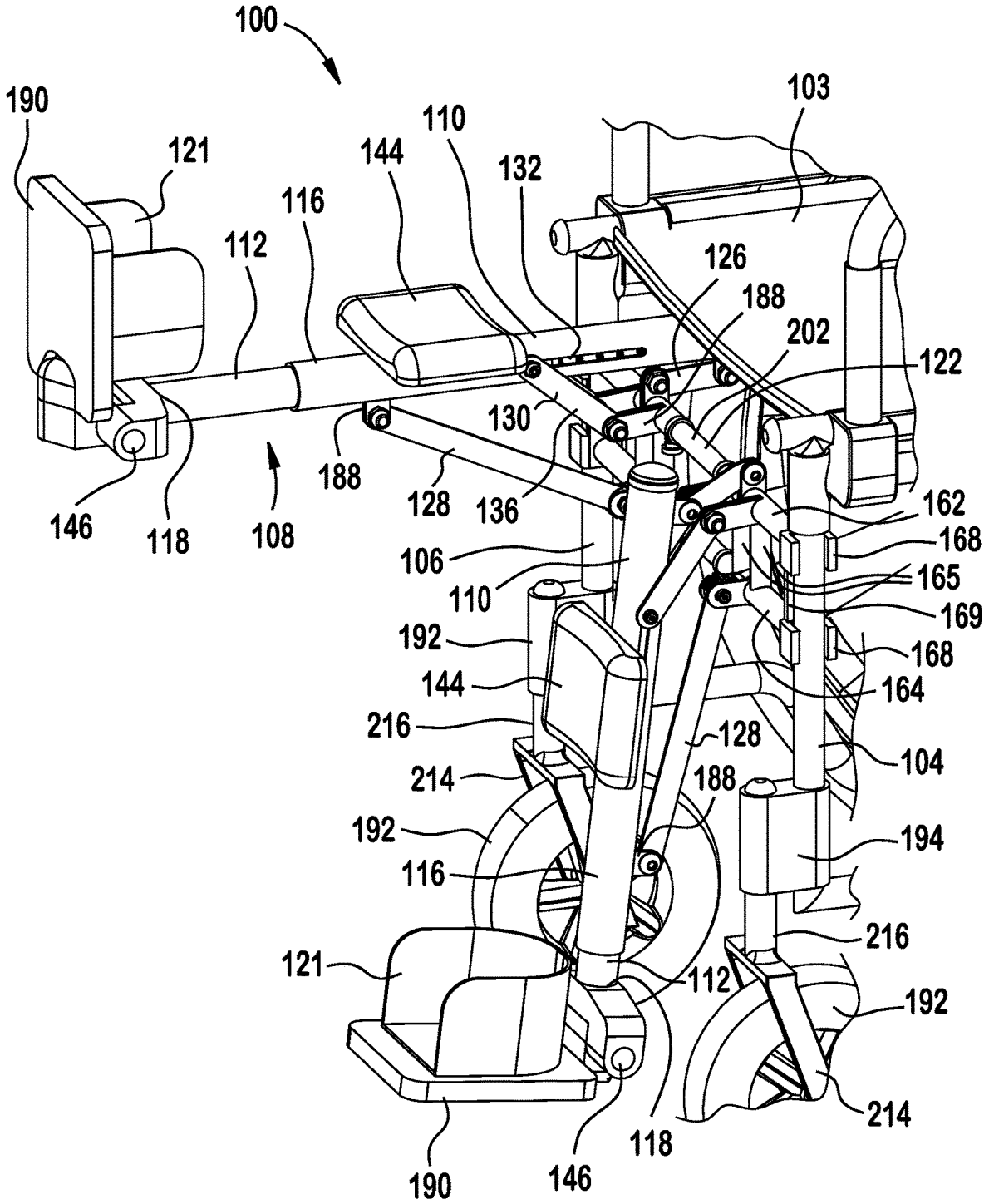
FIG. 2 is a partial front perspective view of a leg assembly 100 in the preferred embodiment shown in use with a wheelchair 102. This figure illustrates a leg support post 108 in a first, retracted position 140 and the leg support post 108 in a second, extended position 142. The leg support post 108 comprises an outer tube 110 configured to partially enclose an inner tube 112. The outer tube 110 has a proximal outer tube end 114 located proximate the mounting-assembly 122 and a distal outer tub end 116 located distally away from the proximal outer tube end 114. The inner tube 112 has a distal inner tube end 118 located proximate the distal outer tube end 116 when the leg support post 108 is in the first, retracted position 140. The outer tube 110 further comprises a calf cushion 144 to support the calf of the leg of the user. This figure also illustrates the inner tube 112 being connected at the distal inner tube end 118 to a foot rest 120 via a joint 146.

Referring now to FIGS. 1 and 2, the leg support post 108 may comprise an outer tube 110, an inner tube 112, and a foot rest 120. The leg support post 108 may be in a first, retracted position 140, a second, extended position 142, or anywhere therebetween. Preferably, the inner tube 112 may have a diameter close to but less than the diameter of the outer tube 110 such that the inner tube 112 may be partially enclosed by the outer tube 110. "Close to but less than" preferably means the diameter of inner tube 112 is at least fifty percent (50%) of the diameter of outer tube 110 but is strictly less than one hundred percent (100%) of the diameter of the outer tube 110. More preferably, "close to but less than" means the diameter of inner tube 112 is at least seventy five percent (75%) of the diameter of outer tube 110 but is strictly less than one hundred percent (100%) of the diameter of the outer tube 110. More preferably still, "close to but less than" means the diameter of inner tube 112 is at least ninety percent (90%) of the diameter of outer tube 110 but is strictly less than one hundred percent (100%) of the diameter of the outer tube 110. Most preferably, "close to but less than" means the diameter of inner tube 112 is at least ninety five percent (95%) of the diameter of outer tube 110 but is strictly less than one hundred percent (100%) of the diameter of the outer tube 110.

Still referring to the preferred embodiment of FIGS. 1 and 2, the outer tube 110 may have a proximal outer tube end 114 and a distal outer tube end 116. The inner tube 112 may have a distal inner tube end 118. "Partially enclosed" preferably means that at most fifty percent (50%) of the inner tube 112 protrudes from the distal outer tube end 116 when the leg support is in the first, retracted position 140. More preferably, "partially enclosed" means that at most twenty five percent (25%) of the inner tube 112 protrudes from the distal outer tube end 116 when the leg support 108 is in the first, retracted position 140. More preferably still, "partially enclosed" means that at most ten percent (10%) of the inner tube 112 protrudes from the distal outer tube end 116 when the leg support 108 is in the first, retracted position 140. Most preferably, "partially enclosed" means that at most five percent (5%) of the inner tube 112 protrudes from the distal outer tube end 116 when the leg support 108 is in the first, retracted position 140.

Still referring to the preferred embodiment of FIGS. 1 and 2, the proximal outer tube end 114 may be located under the seat 103 of the wheelchair 102 when the leg assembly attached to the wheelchair 102. The inner tube 112 may be configured to slide with the outer tube 110. The distal inner tube end 118 may not be contained within the outer tube 110 at any point while the inner tube 112 slides into or out of the outer tube 110. The foot rest 120 may be secured to the inner tube 112 proximate the distal inner tube end 118. Preferably, "proximate" means that the claimed element is within twelve inches (12") of the distal inner tube end 118. More preferably, "proximate" means that the claimed element is within six inches (6") of the distal inner tube end 118. More preferably still, "proximate" means that the claimed element is within three inches (3") of the distal inner tube end 118. Most preferably, "proximate" means that the claimed element is in direct contact with the distal inner tube end 118.

Referring still to the preferred embodiment of FIGS. 1 and 2, the mounting assembly 122 may be configured to be attachable to the first wheel support beam 104 and the second wheel support beam 106 of the wheelchair 102. The leg support post 108 may be connected to the mounting assembly 122 so that the leg support post 108 can be rotated therearound between the first, retracted position 140 to the second, extended position 142. When the leg support post 108 is in the first, retracted position 140, the leg of the user of the wheelchair 102 may be intended to be supported in a bent position. When the leg support post 108 is in the second, extended position 142, the leg of the user of the wheelchair 102 may be intended to be supported in a less bent position. The mounting assembly 122 may be configured such that when the leg support post 108 moves from the first, retracted position 140 to the second, extended position 142, the inner tube 112 may slide outwardly from the outer tube 110 such that the distal inner tube end 118 may move further away from the distal outer tube end 116. Those of ordinary skill in the art would appreciate from this disclosure that the leg support post 108 may move back to the first, retracted position 140 from the second, extended position 142. When the leg support post 108 may move from the first, retracted position 140 to the second, extended position 142, the proximal outer tube end 114 may follow an arcuate path 180 (seen in FIG. 9). The mounting assembly 122 may be configured such that when the mounting assembly 122 is attached to the wheelchair 102, the mounting assembly 122 may be located under the seat 103 and between the first wheel support beam 104 and the second wheel support beam 106.

Figure 3:
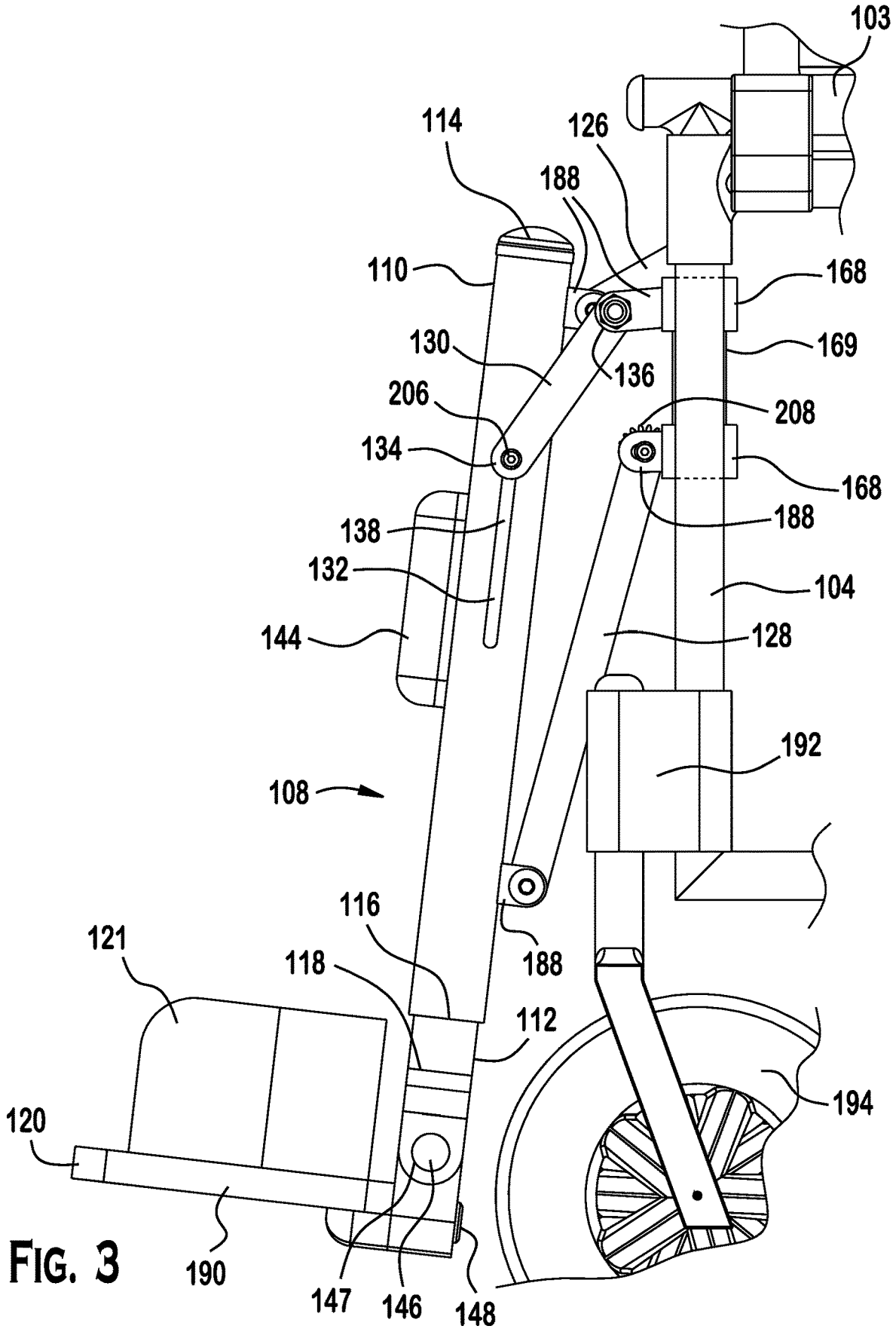
FIG. 3 is a side view of a leg assembly 100 in the preferred embodiment shown in use with a wheelchair 102. This figure illustrates a leg support post 108 in a first, retracted position 140. The leg support post 108 connects to a mounting assembly 122 via a first linkage 126, a second linkage 128, and a third linkage 130. The first linkage 126 and the second linkage 128 are connected to an outer tube 110 of the leg support post 108. The third linkage 130 is connected to a portion 138 of an inner tube 112 of the leg support post 108 via a slot 132 in the outer tube 110. The inner tube 112 is connected at a distal inner tube end 118 to a foot rest 120 via a joint 146. The foot rest 120 comprises a heel support 121.
Figure 4:
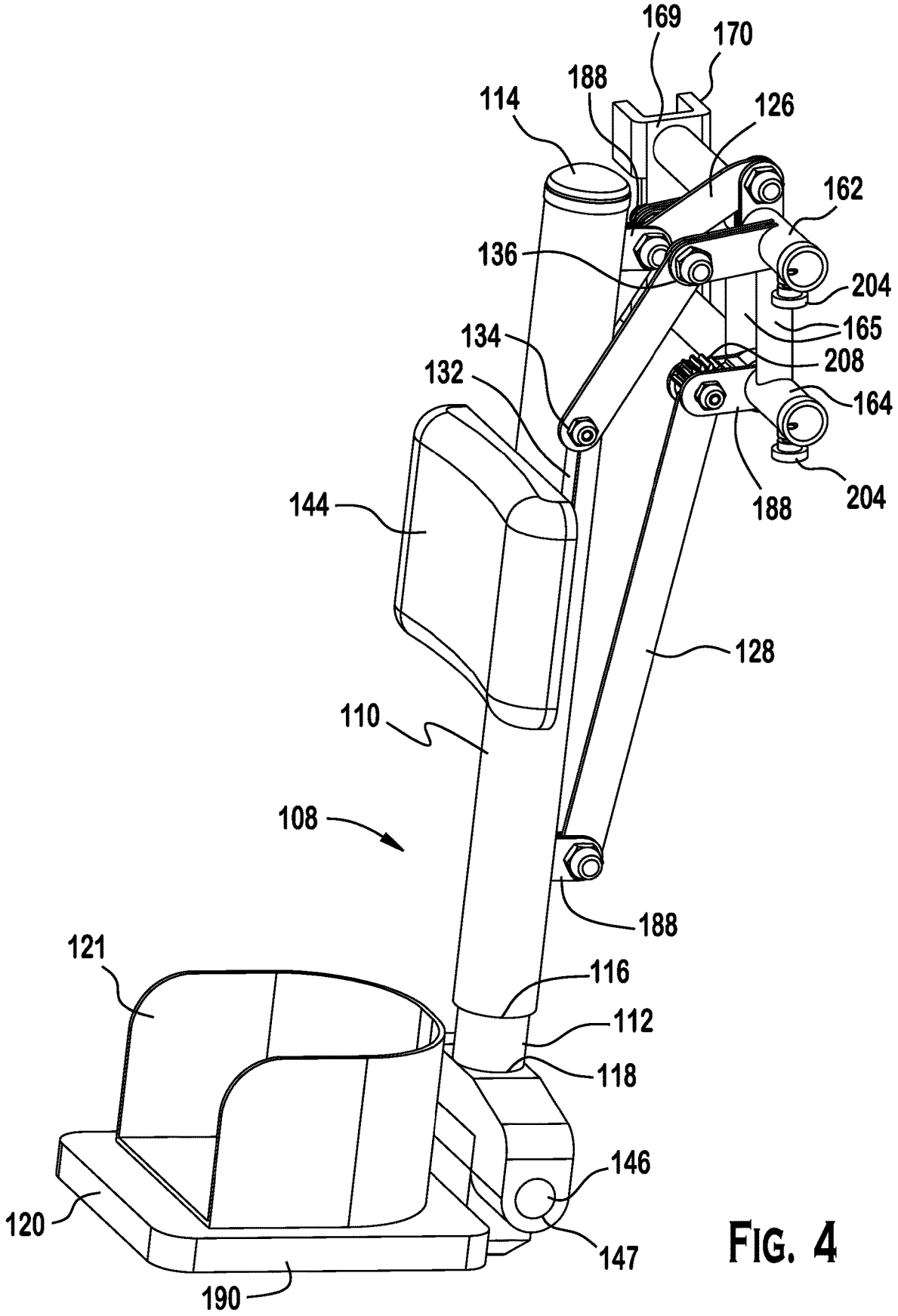
FIG. 4 is a side perspective view of a leg assembly 100 in the preferred embodiment comprising a leg support post 108 shown in a first, retracted position 140. The leg support post 108 connects to a mounting assembly 122 via a first linkage 126, a second linkage 128, and a third linkage 130. The first linkage 126 connects an outer tube 110 of the leg support post 108 to an upper horizontal bar 162 of an H-frame 160. The second linkage 128 connects the outer tube 110 of the leg support post 108 to a lower horizontal bar 164 of the H-frame 160. The third linkage 130 is connected to a portion 138 of an inner tube 112 exposed by a slot 132 in the outer tube 110. The third linkage 130 is connected to the inner tube 112 at a third linkage tube end 134. The third linkage 130 is connected to the mounting assembly 122 at a third linkage frame end 136.

Referring now to FIGS. 3 and 4 of the preferred embodiment, the leg assembly 100 may be seen in the first, retracted position 140. The leg support post 108 may be connected to the mounting assembly 122 via a first linkage 126 and a second linkage 128. The first linkage 126 and the second linkage 128 may engage the mounting assembly 122 at a different height when the mounting assembly 122 is attached to the wheelchair 102. The mounting assembly 122 may comprise an H-frame 160. The H-frame 160 may further comprise an upper horizontal bar 162 and a lower horizontal bar 164. One of ordinary skill in the art would appreciate from this disclosure that the H-frame 160 may be adapted to be used with a wheelchair 102 of any variable width, height, or other dimensions as required by the anatomical specifics of the user, without departing from the scope of the present invention. One of ordinary skill in the art would also appreciate from this disclosure that the H-frame 160 may be used with hemi, pediatric, standard, tall, bariatric, or any other wheelchair configuration, without departing from the scope of the present invention. The upper horizontal bar 162 and the lower horizontal bar 164 each may have the ability to telescope and span a gap 166 located between the first wheel support beam 104 and the second wheel support beam 106. Preferably, "the ability to telescope" means the upper horizontal bar 162 and the lower horizontal bar 164 can become shorter or longer depending on the length of the gap 166 demanded by the wheelchair 102. The upper horizontal bar 162 and the lower horizontal bar 164 may connected and vertically separated at corresponding distal ends by a first mounting bracket 168 and a second mounting bracket 170. The first mounting bracket 168 may affix the leg assembly 100 to the first wheel support beam 102. The second mounting bracket 170 may affix the leg assembly 100 to the second wheel support beam 104.

Referring still to FIGS. 3 and 4 of the preferred embodiment, the first linkage 126 may connect to the H-frame 160 at the upper horizontal bar 162. The second linkage 128 may connect to the H-frame 160 at the lower horizontal bar 164. At the ends of the first linkage 126 and the 128 located distally away from their connections to the H-frame 160, the first linkage 126 and the second linkage 128 connect to the outer tube 110 toward the proximal outer tube end 114 and toward the distal outer tube end 116, respectively. The first linkage 126 and the second linkage 128 may extend between the outer tube 110 and the mounting assembly 122. The first linkage 126 and the second linkage 128 may be connected at either end by mounting connectors 188. Those of ordinary skill in the art would appreciate from this disclosure that any suitably rotatable means of attaching may be substituted for the mounting connectors 188 without exceeding the scope of this disclosure.

Still referring to FIGS. 3 and 4 of the preferred embodiment, the leg support post 108 may also be connected to the mounting assembly 122 via a third linkage 130. The third linkage 130 may attach at a third linkage frame end 136 to the upper horizontal bar 162, the lower horizontal bar 164, or at a point along a vertical cross beam 165 located therebetween. The outer tube 110 may define a slot 132 therein. The third linkage 130 may be secured at a third linkage tube end 134 to a portion 138 of the inner tube 112 exposed and accessible via the slot 132. The third linkage tube end 134 and the inner tube 112 may move together relative to the outer tube 110 when the leg support post 108 is rotated from the first, retracted position 140 to the second, extended position 142. The first linkage 126, the second linkage 128, and the third linkage 130 may be configured such that when the leg support post 108 is moved from the first, retracted position 140 toward the second, extended position 142, the third linkage 130 may drive the inner tube 112 outwardly from the outer tube 110.

Figure 5:
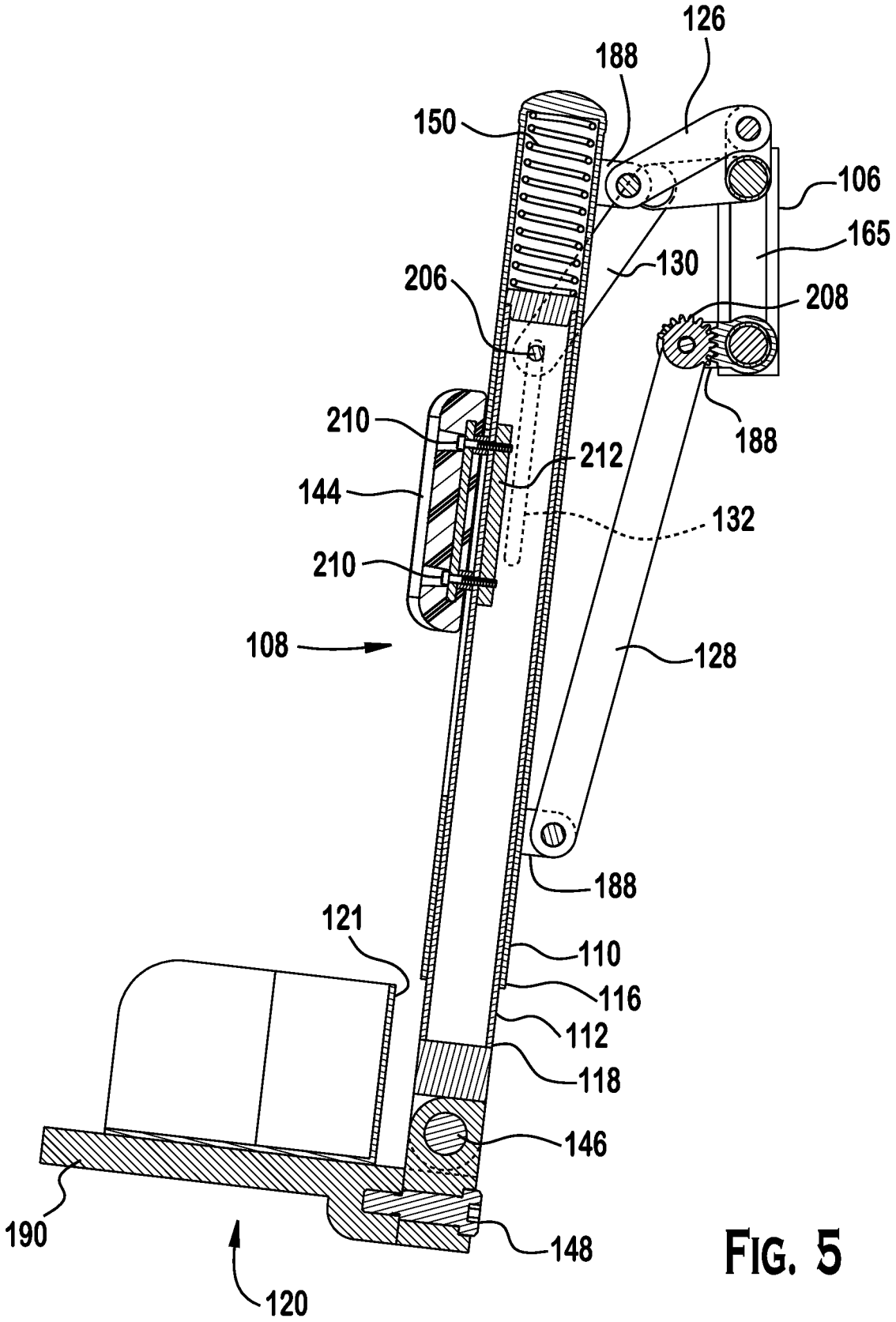

Referring now to FIG. 5 of the preferred embodiment, the leg support post 108 may be configured to provide a biasing force between the outer tube 110 and the inner tube 112. The proximal outer tube end 114 may contain an elastic member 150 within the space not partially enclosing the inner tube 112. The elastic member 150 may be compressed when the leg support 108 is in the first, retracted position 140 as shown in FIG. 5. The biasing force provided by the elastic member 150 may provide a lift assistance force to the user of the wheelchair 102 when moving the leg support post 108 from the first, retracted position 140 toward the second, extended position 142 (seen in FIG. 8). The lift assistance provided by the elastic member 150 may be purely mechanical and free of electrical components, motors, and other non-manual powered devices.

Figure 6:
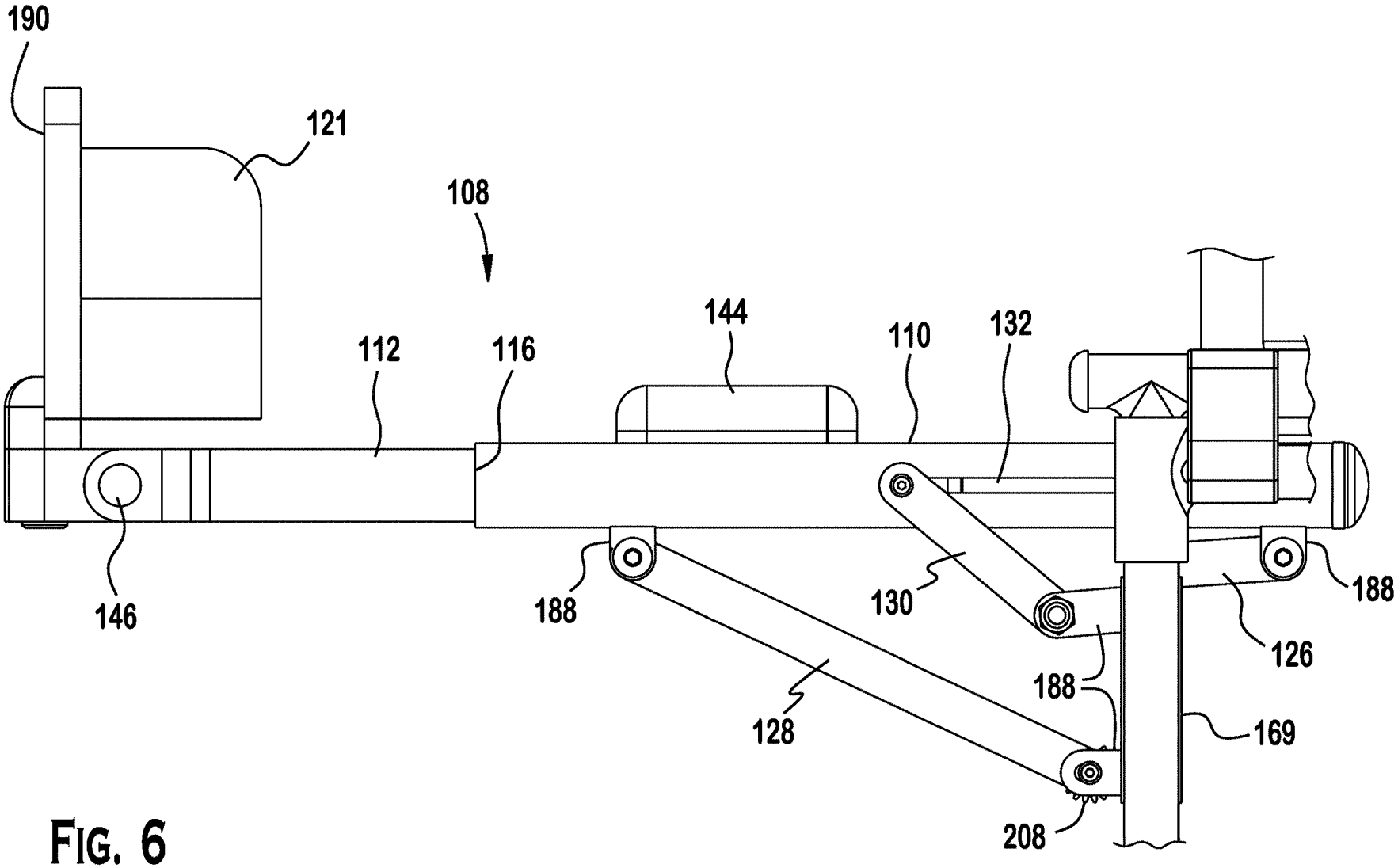
FIG. 6 is a side view of a leg assembly 100 in the preferred embodiment shown in use with a wheelchair 102. This figure illustrates a leg support post 108 in a second, extended position 142. The leg support post 108 connects to a mounting assembly 122 via a first linkage 126, a second linkage 128, and a third linkage 130. The first linkage 126 and the second linkage 128 are connected to an outer tube 110 of the leg support post 108. The third linkage 130 is connected to a portion 138 of an inner tube 112 of the leg support post 108 via a slot 132 in the outer tube 110. Here, the third linkage 130 can be seen connected to the portion 138 of the inner tube 112 at a different point along the slot 132 than the third linkage 130 would be in a first, retracted position 140. This figure also illustrates that a proximal outer tube end 114 of the outer tube 108 is located at least partially beneath a seat 103 of the wheelchair 102 and above the mounting assembly 122.
Figure 7:
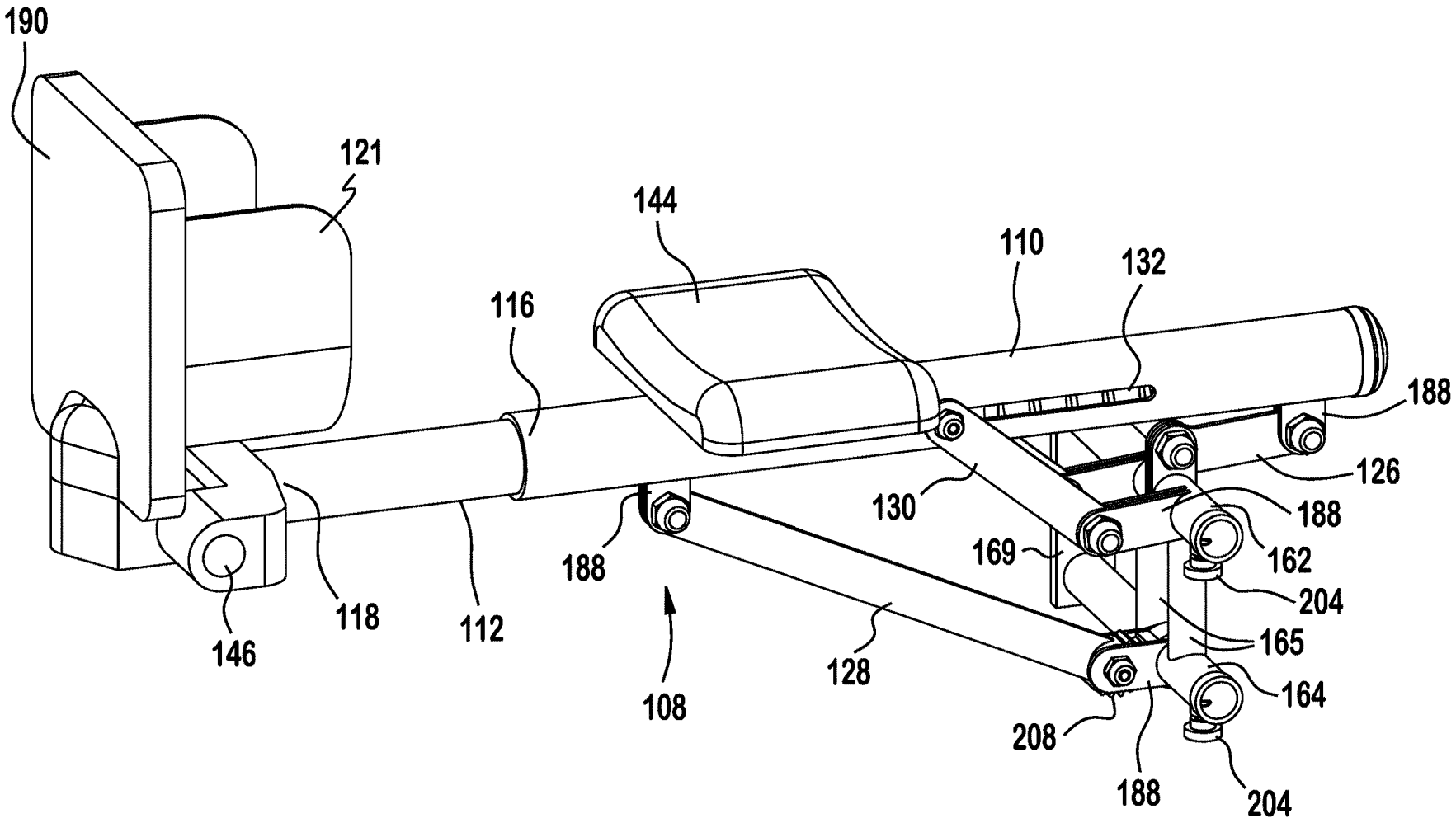
FIG. 7 is a side perspective view of a leg assembly 100 in the preferred embodiment comprising a leg support post 108 shown in a second, extended position 142. The leg support post 108 connects to a mounting assembly 122 via a first linkage 126, a second linkage 128, and a third linkage 130. The first linkage 126 connects an outer tube 110 of the leg support post 108 to an upper horizontal bar 162 of an H-frame 160. The second linkage 128 connects the outer tube 110 of the leg support post 108 to a lower horizontal bar 164 of the H-frame 160. The third linkage 130 is connected to a portion 138 of an inner tube 112 exposed by a slot 132 in the outer tube 110. This figure also illustrates a distal inner tube end 118 of the inner tube 112 telescoping outward and away from a distal outer tube end 116. The leg support post 108 is shown longer in the second, extended position 142 than in the first, retracted position 140.

Referring now to FIGS. 6 and 7 of the preferred embodiment, the leg support post 108 is depicted in the second, extended position 142. Here, it may be seen that the inner tube 112 extends further from the outer tube 100 in the second, extended position 142 than in the first, retracted position 140. The portion 138 of the inner tube 112 exposed and accessible by the slot 132, as well as the third linkage tube end 134 connected to the portion 138, may be located closer the distal outer tube end 114 in the second, extended position 142 than when in the first, retracted position 140.

Figure 8:
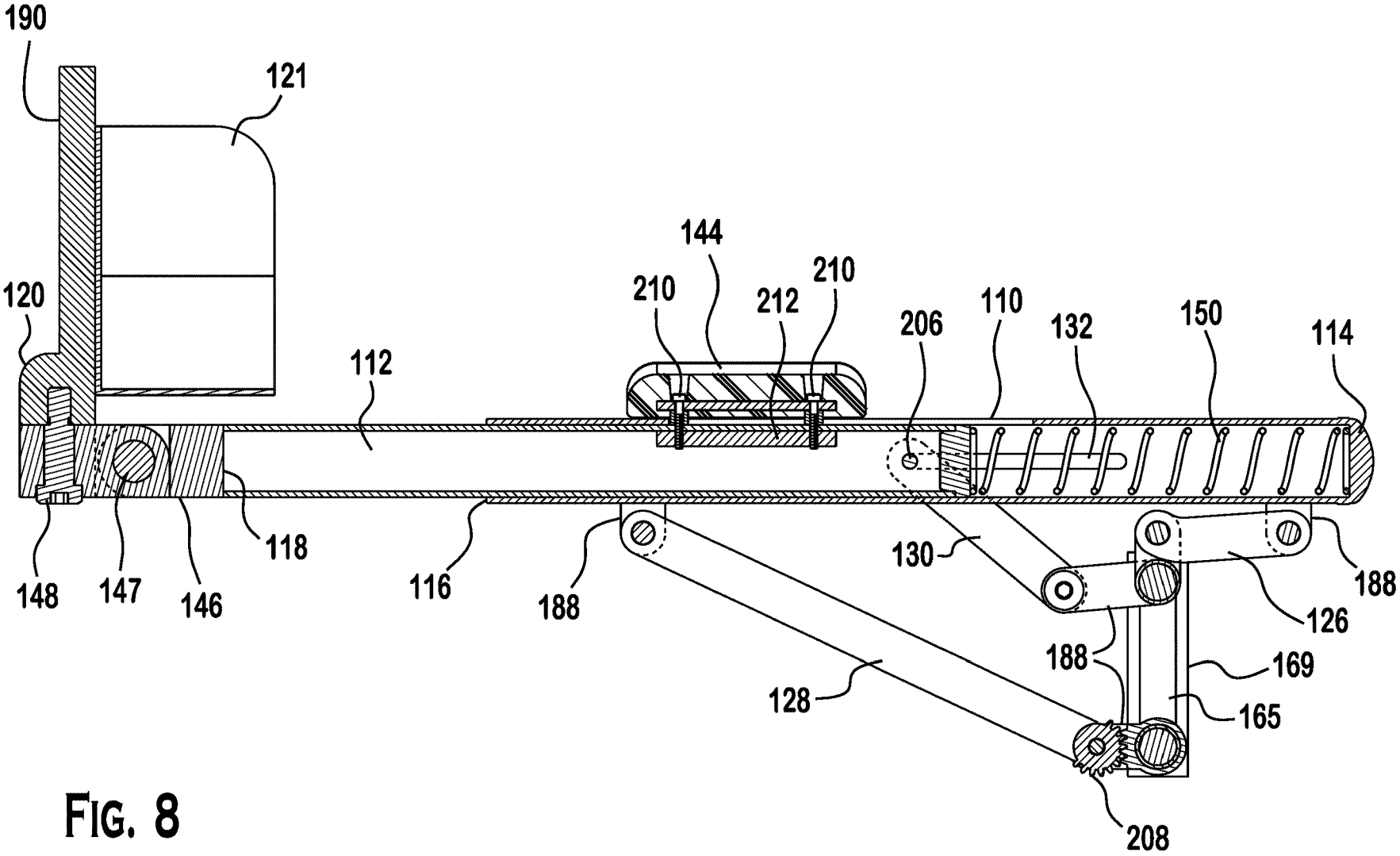
FIG. 8 is a side cross-sectional view of a leg assembly 100 in the preferred embodiment comprising a leg support post 108 shown in a second, extended position 142. The leg support post 108 comprises an outer tube 110 configured to partially enclosing an inner tube 112. The outer tube 110 has a distal outer tube end 114 which is proximate a distal inner tube end 118 of the inner tube 112. The outer tube 110 has a proximal outer tube end 114 which contains an elastic member 150 in the space not enclosing the inner tube 112. This figure further illustrates the extension and non-compression of the elastic member 150 when the leg support post 108 is in the second, extended position 142. A distal inner tube end 118 of the inner tube 112 is telescoping outward and away from a distal outer tube end 116. Less of the inner tube 112 is enclosed by the outer tube 108 when the leg support post 108 is in the second, extended position 142 than in the first, retracted position 140.

Referring now to FIG. 8 of the preferred embodiment, the leg support post 108 is depicted in the second, extended position 142. Here, the elastic member 150 can be seen decompressed as it has already supplied the biasing force from the outer tube 110 against the inner tube 112 and provided the lift assistance force for moving from the first, retracted position 140 toward the second, extended position 142. The lift assistance provided by the elastic member 150 may be purely mechanical and free of electrical components, motors, and other non-manual powered devices. The lift assistance may be adjusted to not only assist with the supporting of the leg of a user but also with the action of rotating the leg of the user. The lift assistance may be altered and tuned properly to gradually and comfortably allow the user to raise or lower the his or her leg without any jerking or sudden motion that may cause pain or other discomfort. One of ordinary skill in the art would appreciate from this disclosure that any sufficiently strong and tunable lift assisting device, such a piston or other hydraulic device, may be substituted for the elastic member 150 without departing from the scope of the present invention.

Referring generally to FIGS. 1-8 of the preferred embodiment, a calf cushion 144 may be disposed on the outer tube 110. The calf cushion 144 may allow the leg of the user of the wheelchair 102 to be aligned over the leg support post 108 while the leg is resting on the calf cushion 144. The foot rest 120 may be adjustably positioned by a joint 146 proximate the distal inner tube end 118. The joint 146 may allow for the foot rest 120 to be angled and canted relative to the leg support post 108 via a first bolt 147 and a second bolt 148. The foot rest 120 may also comprise a heel support 121 to accommodate comfort.

Figure 9:
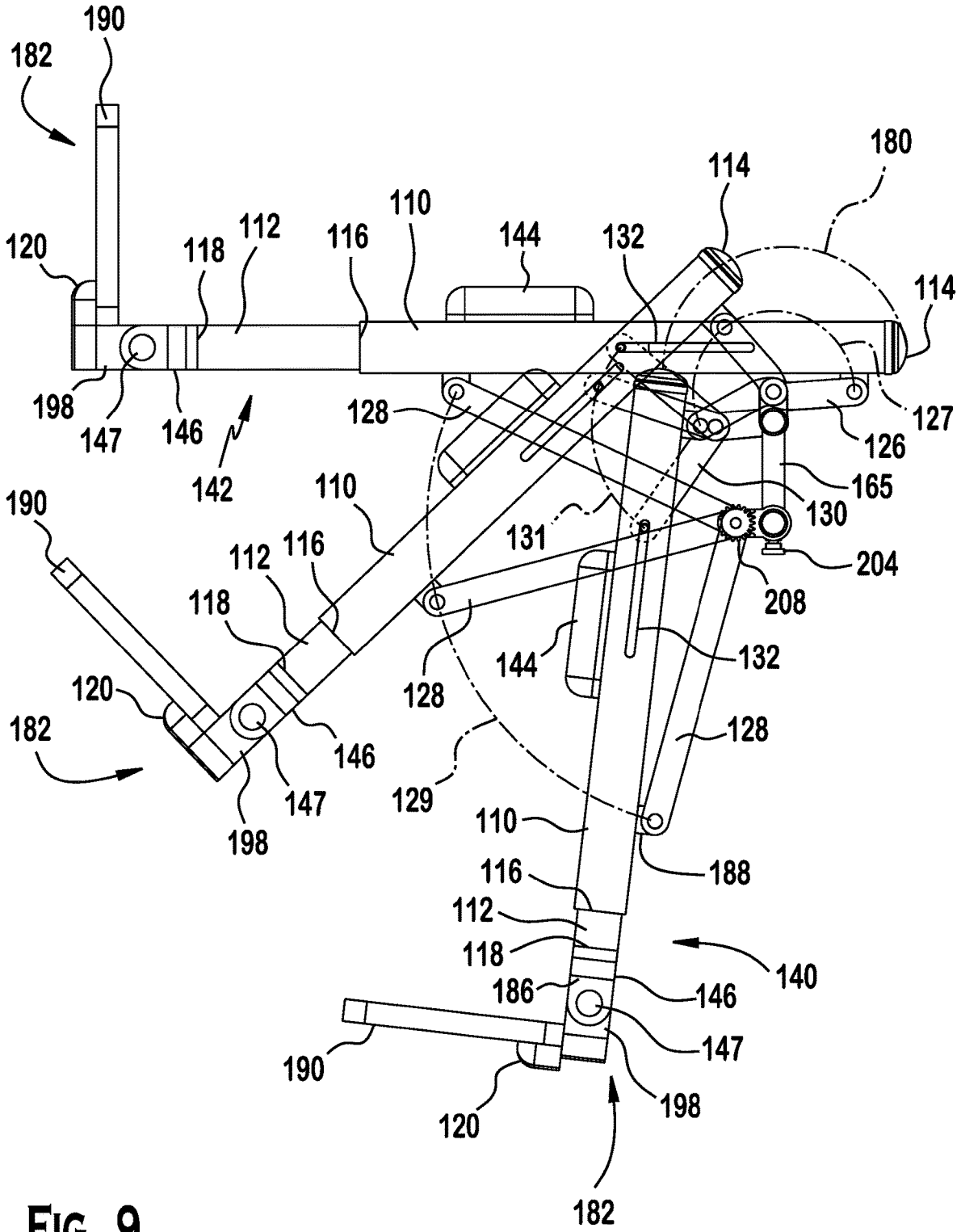
FIG. 9 is a side elevational view of a leg assembly 100 in the preferred embodiment comprising a leg support post 108 being rotated from a first, retracted position 140 to a second, extended position 142. The leg support post 108 comprises an outer tube 110 that partially encloses an inner tube 112. The outer tube 110 has a proximal outer tube end 114 located proximate the mounting-assembly 122 and a distal outer tub end 116 located distally away from the proximal outer tube end 114. This figure illustrates an arcuate path 180 followed by the proximal outer tube end 114 when the leg support post 108 is rotated from the first, retracted position 140 to the second, extended position 142. The inner tube 112 has a distal inner tube end 118 located proximate the distal outer tube end 116 when the leg support post 108 is in the first, retracted position 140. When the leg support post 108 is rotated from the first, retracted position 140 to the second, extended position 142, the distal inner tube end 118 telescopes outwardly and away from a distal outer tube end 116. Less of the inner tube 112 is enclosed by the outer tube 108 when the leg support post 108 is in the second, extended position 142 than in the first, retracted position 140.

Referring now to FIG. 9 of the preferred embodiment, the leg support post 108 may be seen in rotation from the first, retracted position 140 to the second, extended position. The leg support post 108 may follow an arcuate path 180 along the proximal outer tube end 114 when rotated from the first, retracted position 140 to the second, extended position 142. In addition to the first, retracted position 140 and the second, extended position 142, the leg support post 108 may occupy any one of a plurality of positions 182 located therebetween. When the leg support post 108 is rotated from the first, retracted position 140 to the second, extended position 142, the distal inner tube end 118 may telescope outwardly and away from the distal outer tube end 116. Progressively less and less of the inner tube 112 may be partially enclosed by the outer tube 108 when the leg support post 108 rotates from the first, retracted position 140 toward the second, extended position 142. Those of ordinary skill in the art would appreciate from this disclosure that the leg support post 108 may also be rotated freely from the second, extended position 142 toward the first, retracted position 140 along the arcuate path 180 without departing from the scope of this disclosure. The first linkage 126 may follow a first linkage arcuate path 127 when the leg support post 108 is rotated from the first, retracted position 140 toward the second, extended position 142. The second linkage 128 may follow a second linkage arcuate path 129 when the leg support post 108 is rotated from the first, retracted position 140 toward the second, extended position 142. The third linkage 130 may follow third linkage arcuate path 131 when the leg support post 108 is rotated from the first, retracted position 140 toward the second, extended position 142.

Figure 10:
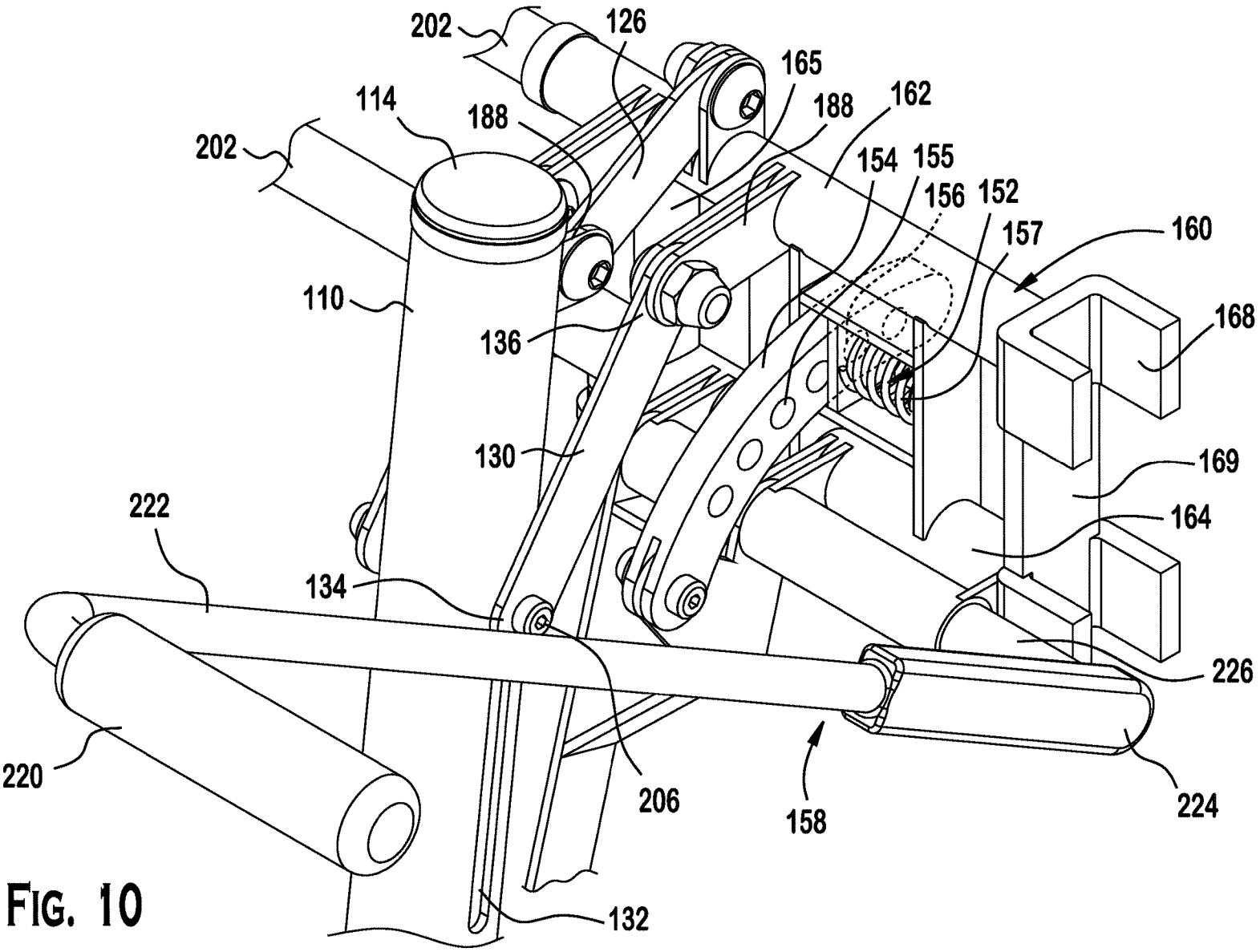
FIG. 10 is a broken away, enlarged, perspective view of a leg assembly 100 in the preferred embodiment comprising a mounting assembly 122. This figure illustrates a pin lock mechanism 152 incorporated by the mounting assembly 122. The pin lock mechanism 152 comprises a rounded bar 154 that has a plurality of holes 155. A pin 156 fixed to the pin lock mechanism can also be seen in the figure. One of the plurality of holes 155 of the round bar 154 is engaged with the pin 156 by a plate elastic member 157 extending from the pin lock mechanism 152 opposite the pin 156. One of a plurality of positions 182 of the leg support post 108 is secured relative to the mounting assembly 102 depending on which of the plurality of holes 155 the pin 156 engages. This figure also shows a lever 158 to be used for disengaging the pin lock mechanism 152.

Referring now to FIG. 10 of the preferred embodiment, the leg assembly 100 may further comprise a pin lock mechanism 152. The leg support 108 may be detachably fixed into any one of the plurality of positions 182 via the pin lock mechanism 152. The pin lock mechanism 152 may comprise a rounded bar 154 having a plurality of holes 155 and a pin 156 fixed to one side of the pin lock mechanism 152. The pin lock mechanism 152 may also comprise a plate elastic member 157 extending opposite the pin 156. One of the plurality of holes 155 of the round bar 154 may be biased into engagement with the pin 156 by the plate elastic member 157. The one of the plurality of positions 182 in which the leg support post 108 may be secured relative to the mounting assembly 122 may depend on which of the plurality of holes 155 the pin 156 engages. The leg assembly 100 may further comprise a lever 158 for manually disengaging the rounded bar 154 from the pin 156 against the plate elastic member 157 and providing a lift assistance for moving the leg support post 108. The lift assistance provided by the lever 158 may be purely mechanical and free of electrical components, motors, and other non-manual powered devices. The lever 158 may vary in length depending on whether the leg support post 108 is to be adjusted by the wheelchair user or another external user.

Figure 11:
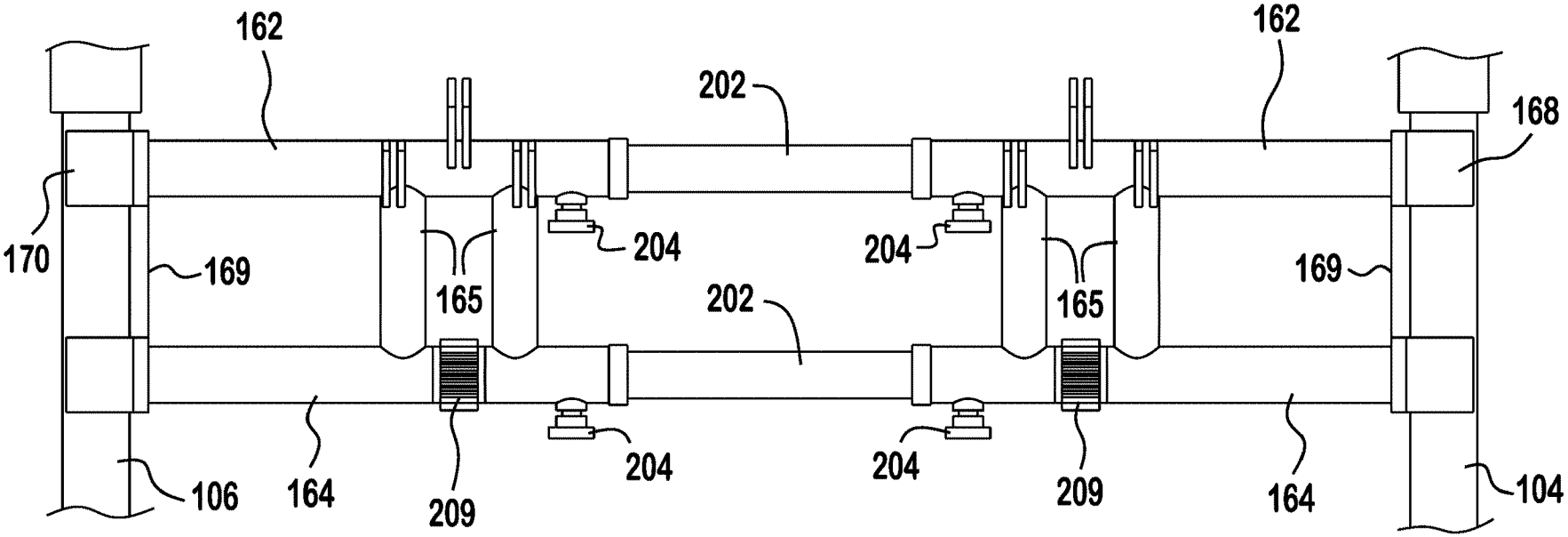
FIG. 11 is a partial, broken away, front elevational view of the leg assembly 122. Two H bar frames 160 are illustrated, each connecting to a separate one of the first and second wheel support beams 104, 106. The H-frames 160 are preferably connected to the first and second wheel support beams 104, 106 via brackets 168, 170, respectively. Each of the brackets 168, 170 include a bracket plate 169 which extends between an upper horizontal bar 162 a lower horizontal bar 164. The upper and lower horizontal bars 162, 164 also preferably connected via vertical cross beams 165. It is preferred that the upper and lower horizontal bars 162, 164 are hollow to allow for a telescoping attachment 202 to be stored therein and extended as desired. The position of the telescoping attachment 202 can be adjusted and secured via a lock mechanism 204. The telescoping attachment 202 preferably allows the H-frames 160 to be secured together to form a common bracing member between the first and second wheel support beams 104, 106. The telescoping attachments 202 also allow for the gap 166 between the first and second wheel support beams 104, 106 to vary so that the mounting assembly 122 can be used with different sized wheelchairs. Mounting connectors 188 are preferably located on the H-frame 160 to facilitate connection of various linkages. Toothed gears 209 may optionally be incorporated into the mounting assembly 122 depending upon desired mechanical characteristics.
Figure 12:
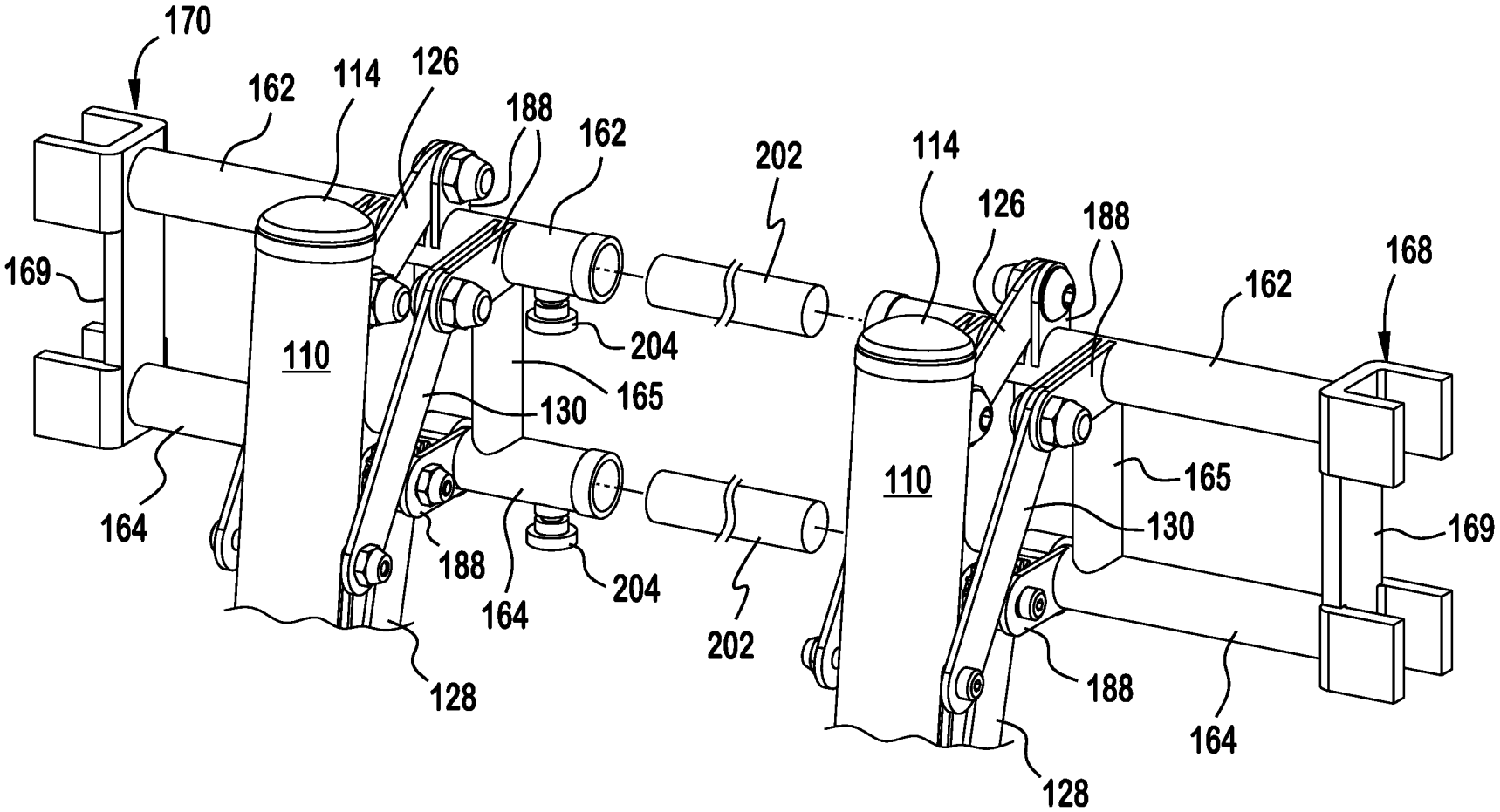
FIG. 12 is a perspective, broken away, exploded view of the mounting assembly 122.

Referring now to FIGS. 11 and 12 of the preferred embodiment, the mounting assembly 122 may be see comprising two H-frames 160. The H-frames 160 may be connected at corresponding upper horizontal bars 162 and lower horizontal bars 164 by telescoping attachments 202. The diameter of the telescoping attachment 202 may be close to but less than the diameter of the upper and lower horizontal bars 162, 164 such that the telescoping attachments 202 may slide inwardly into and outwardly from the upper and lower horizontal bars 162, 164 in order to fill the gap 166 created by the first and second wheel support beams 104, 106. The telescoping attachments 202 may be locked into a desired position within the upper and lower horizontal bars 162, 164 via lock mechanisms 204. Mesh gears 209 may be disposed on the upper and lower horizontal bars 162, 164. The mesh gears 209 may be used to engage the first linkage 126, the second linkage 128, and the third linkage 130. The optional mesh gear 209 may be used instead of the mounting connectors 188 in order to provide an additional element of rigidity in locking the leg support post 108 into any one of the plurality of positions 182. The mounting connectors 188 may comprise two planar parallel flanges protruding from their corresponding component wherein the connected link or component may lie therebetween and be rotationally fixed in place via a pin or the like. The outer edges of the mounting connectors 188 may be rounded to facilitate rotational movement of the corresponding components around the outer edge. One of ordinary skill in the art would appreciate from this disclosure that any suitable flexible, pivotal, or otherwise rotationally affixable device may be substituted for the mounting connectors 188 without departing from the scope of the present invention.

Figure 13:
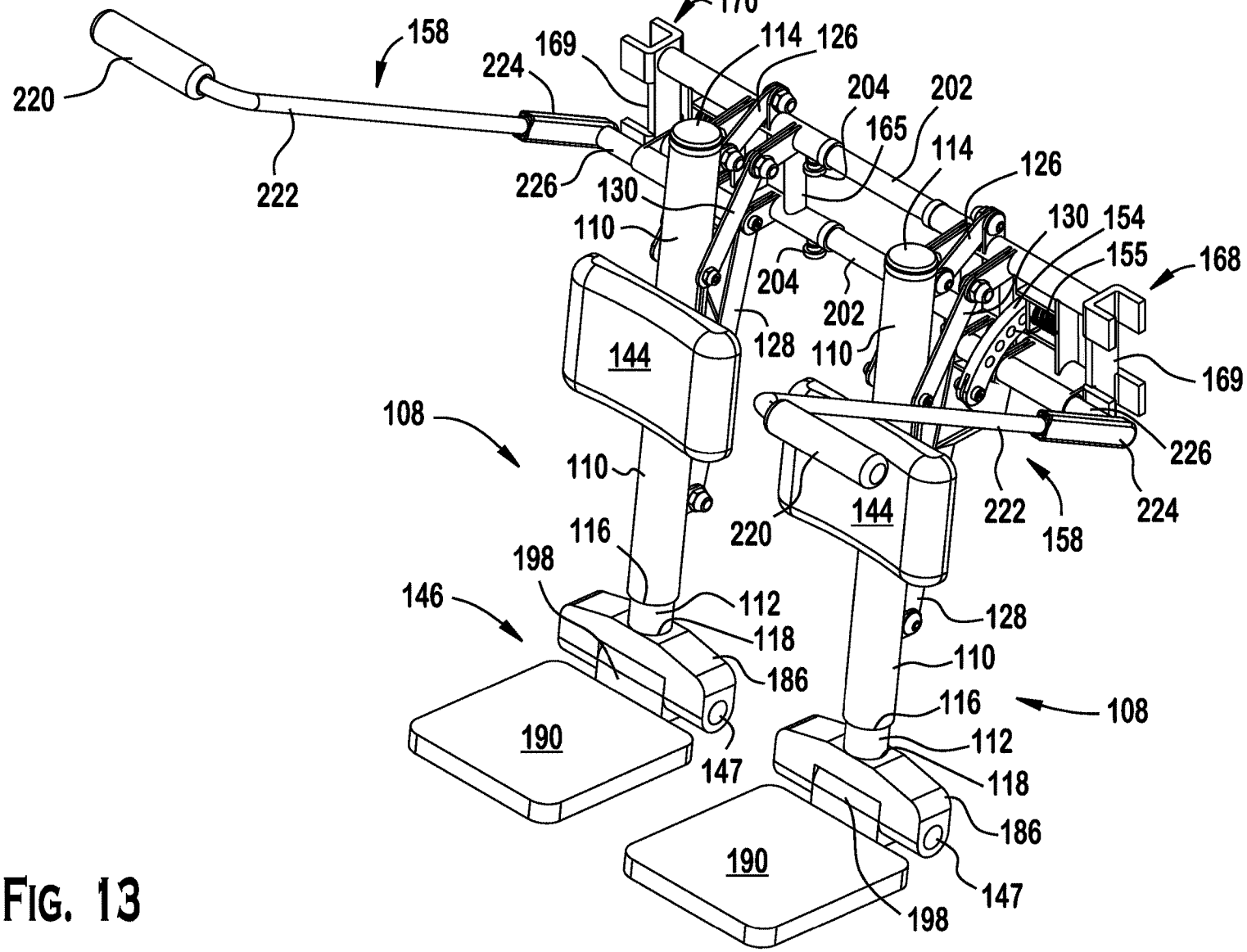
FIG. 13 is a perspective view of the mounting assembly 122 illustrating handles 158. The handles 158 may be linked to rounded bars 154 so that rotation of the handle 158 moves the associated rounded bar 154. This allows for the angular position of the leg support 108 relative to the chair to be adjusted and secured in a desired position. Specifically, the rounded bar 154 includes a plurality of holes 155 therein that can engage a pin 156 located on the mounting assembly 122. Once a user has rotated the leg support 108 into the proper position, the pin 156 is inserted into the corresponding hole 155 of the rounded bar 154 to secure the leg post 108 in the desired position. Foot rests 120 are shown without the optional heel support 121. The foot rest 120 may include a mating hinge 186 which is connected to hinge 198 via first bolt/pin 147. The hinge 198 is preferably connected to footplate 190. It is preferred that the angle between the footplate 190 and the outer tube 110 can be adjusted and secured so that accommodation can be made depending upon the musculoskeletal structure of the user.

Referring now to FIG. 13 of the preferred embodiment, the leg assembly 100 can be seen sent into the first, retracted position 140. The outer tube 110 may be rotated about the upper horizontal bar 162 at the same time as the proximal outer tube end 114 increasingly becomes distant to the third linkage tube end 134 connected via a pin 206 to the portion 138 of the inner tube 112. Alternatively, the outer tube 110 may rotate around the upper horizontal tube 162 while the actual the geometric center of rotation about which the outer tube 110 rotates is not located on the outer tube 110 nor along at any point coexistent with the longitudinal axis of the outer tube 110. It is preferred that the inner tube 112 moves laterally within the outer tube 110 during any and all rotation of the outer tube 110 toward or away from the second, extended position 142.

Figure 14:
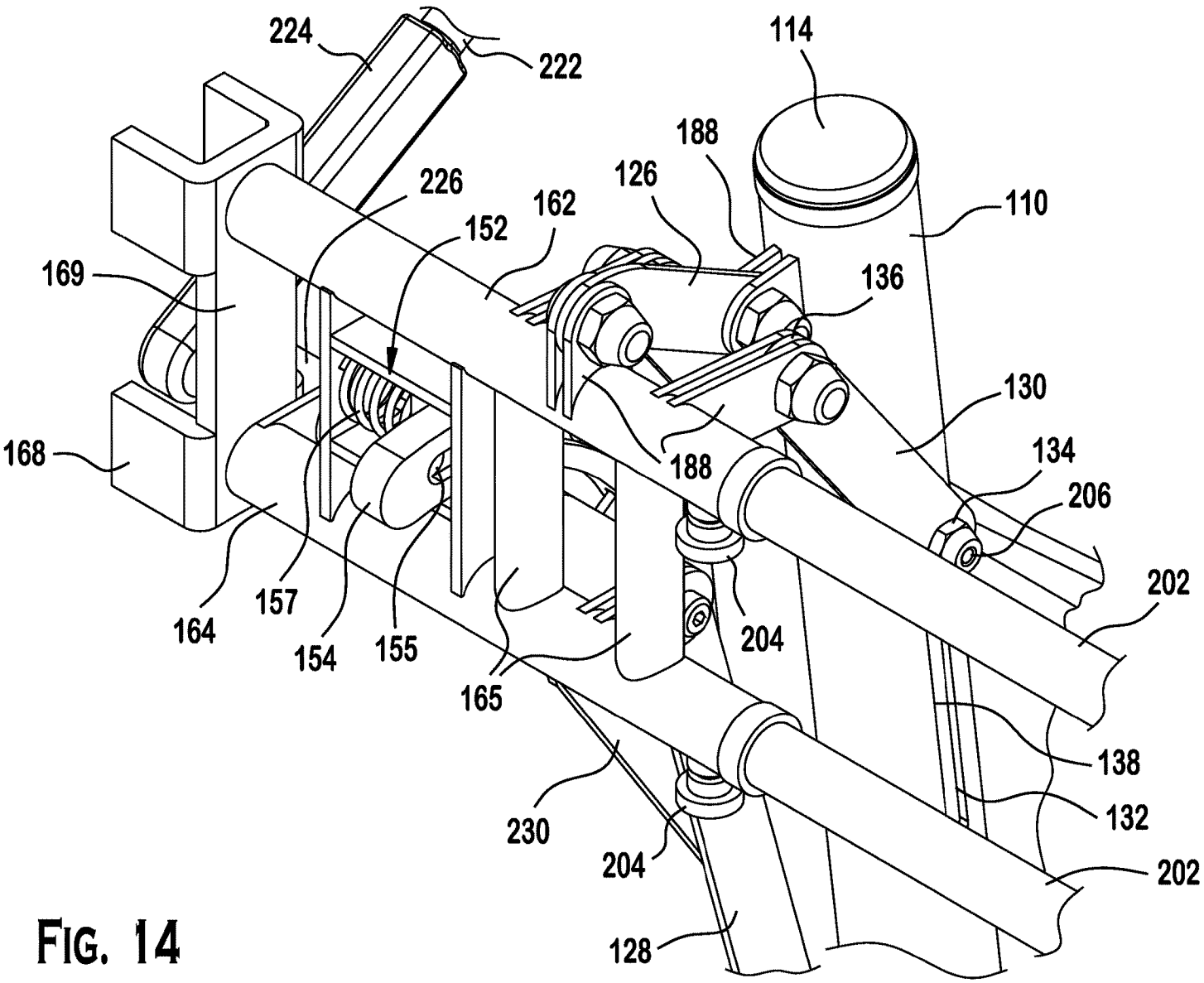
FIG. 14 is a rear perspective, partial, broken away view of the mounting assembly 122 illustrating a plate elastic member 157 driving the rounded bar 154 into engagement with the pin 156 so as to lock the leg support 108 in the current position. The rounded bar 154 can be disengaged from the pin 156 by pulling the lever 158 laterally outwardly so as to compress the plate elastic member 157 and allow the end of the rounded bar 154 to move generally outwardly out of engagement with the pin 156. Once the rounded bar 154 is disengaged, the angle of the leg support 108 can be adjusted.

Referring now to FIG. 14 of the preferred embodiment, the pin lock mechanism 152 can be seen with the rounded bar 154 engaged by the plate elastic member 157. The pin lock mechanism 152 may be constructed out of any sufficiently lubricated or friction resistant material so as to facilitate the movement of the rounded bar 154 through the pin lock mechanism 152 and across the contacting surface of the plate elastic member 157. To reduce the impact of any friction, the rounded bar 154 as well as the other various components of the pin lock mechanism 152 may be constructed of highly durable materials.

Figure 15:
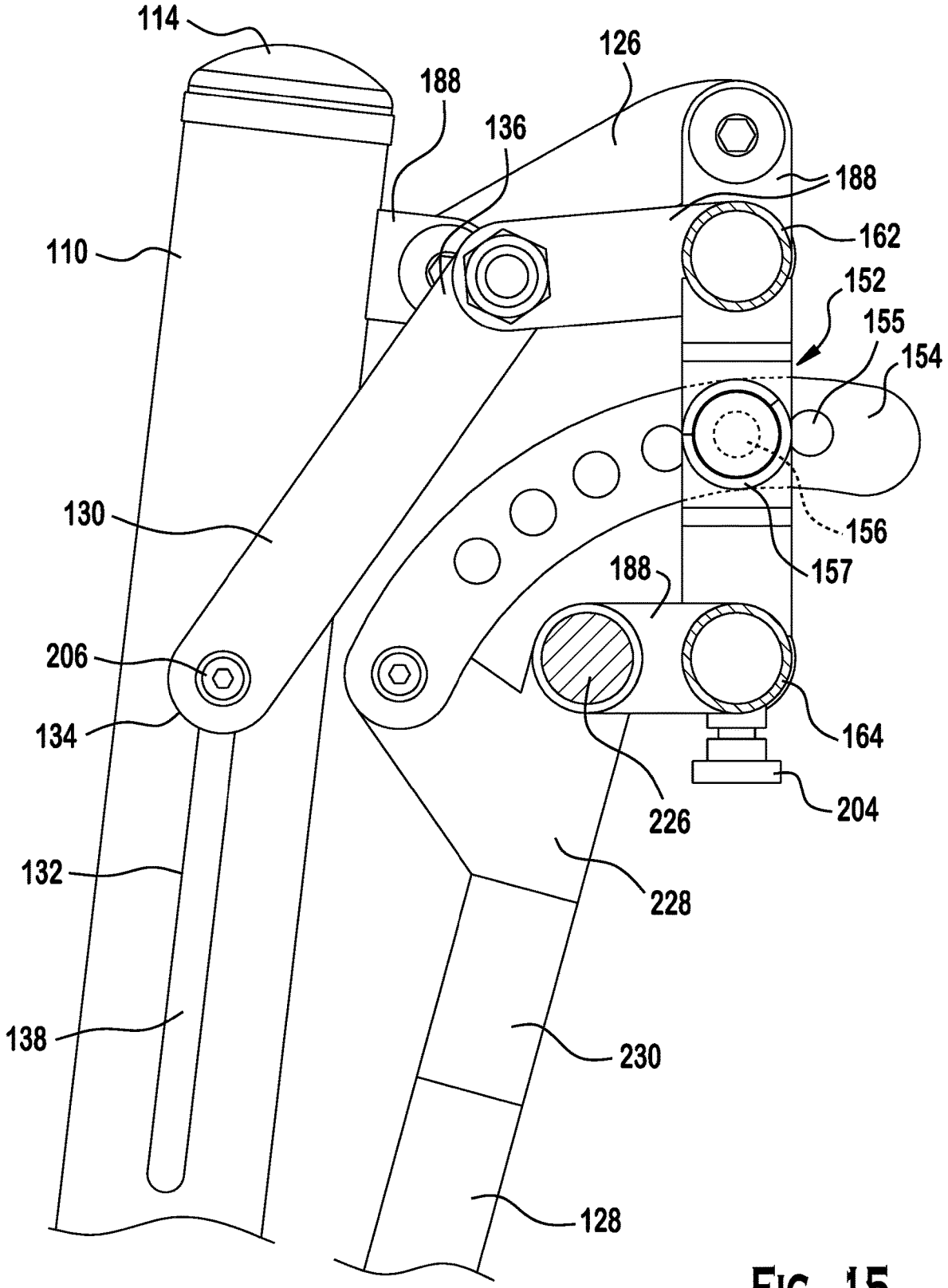
FIG. 15 is a side elevational, broken away view of the mounting assembly 122. Pin 156 is shown engaged with a hole 155 in the rounded bar 154 to secure the leg support post 108 and position. When a user wishes to adjust the angular position of the leg support post 108 relative to the seat 103 of the wheelchair 102, the user disengages the pin 156 from the rounded bar 154 and adjusts the position of the leg support 108. Once everything is positioned properly, the user stops applying force on the plate elastic member 157 and allows the plate elastic member 157 to drive the rounded bar 154 into engagement with the pin 156.

Referring now to FIG. 15 of the preferred embodiment, the lever 158 can be seen engaged with a bar support plate 228 via a lateral adjustment bar 226 of the lever 158. The bar support plate 228 connects the action, torque, momentum, manual power, and other work provided by the lever 158 to disengage the rounded bar 154 from the pin 156 and rotate the rounded bar 154 through the pin lock mechanism 152. The bar support plate 228 also connects the action, torque, momentum, manual power, and other work provided by the lever 158 to the second linkage 128 via a synchronizing link bar 230. In this way, the lever 158 not only engages the rounded bar 154, but also assists in raising the leg support post 108 when the user of the wheelchair wants to raise or lower their leg.

Figure 16:
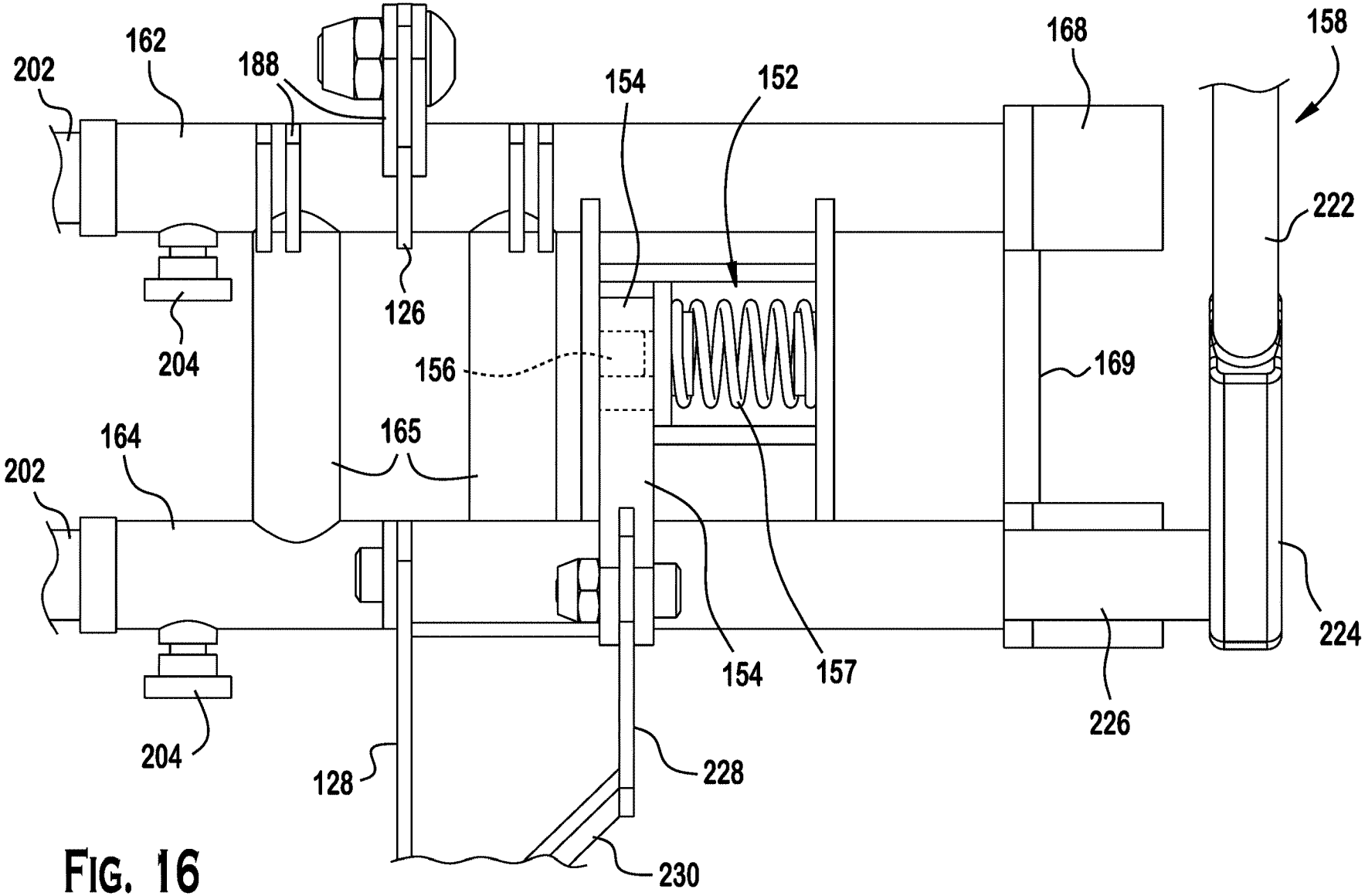
FIG. 16 is a front side, partial, broken away view of the mounting assembly 122 illustrating the engagement between the rounded bar 154 and the pin 156. The plate elastic member 157 can be used to secure the rounded bar 154 against the pin 154 to prevent accidental disengagement. The operation of the plate elastic member 157 can be mechanically actuated or mechanized without departing from the scope of the present invention. The rounded bar 154 may, but is not necessarily, connected to the second linkage 128 via synchronizing link bar 230 and bar support plate 228.

Referring now to FIG. 16 of the preferred embodiment, the plate elastic member 157 can be seen engaging the rounded bar 154 with the pin 156. In this way, the position of the rounded bar 154 may be maintained statically with the pin 156. The force exerted by the plate elastic member 157 on the rounded bar 154 may allow for the entire leg support post 108 to remain in a fixed position against the weight of a user's leg.

Referring still to FIG. 16 of the preferred embodiment, the H-frame 160 may be advantageous to use in a variety of manners for securing devices, objects, storage, and/or other features under the seat 103 of the wheelchair 102. The upper and lower horizontal bars 162, 164 working in conjunction with the vertical support beams 165 as well as the first and second mounting brackets 168, 170 may provide for very high mounting loads and load bearing capacities in general. The brackets 168, 170 may be affixed, either permanently or temporarily, to the first and second wheel support beams 104, 106 by a variety of attaching devices such as screws, bolts, fasteners, glue, tape, adhesives, binders, clamps, friction, or any other means for attaching the mounting assembly 122 to the wheelchair 102 without departing from the scope of the present invention.

Figure 17:
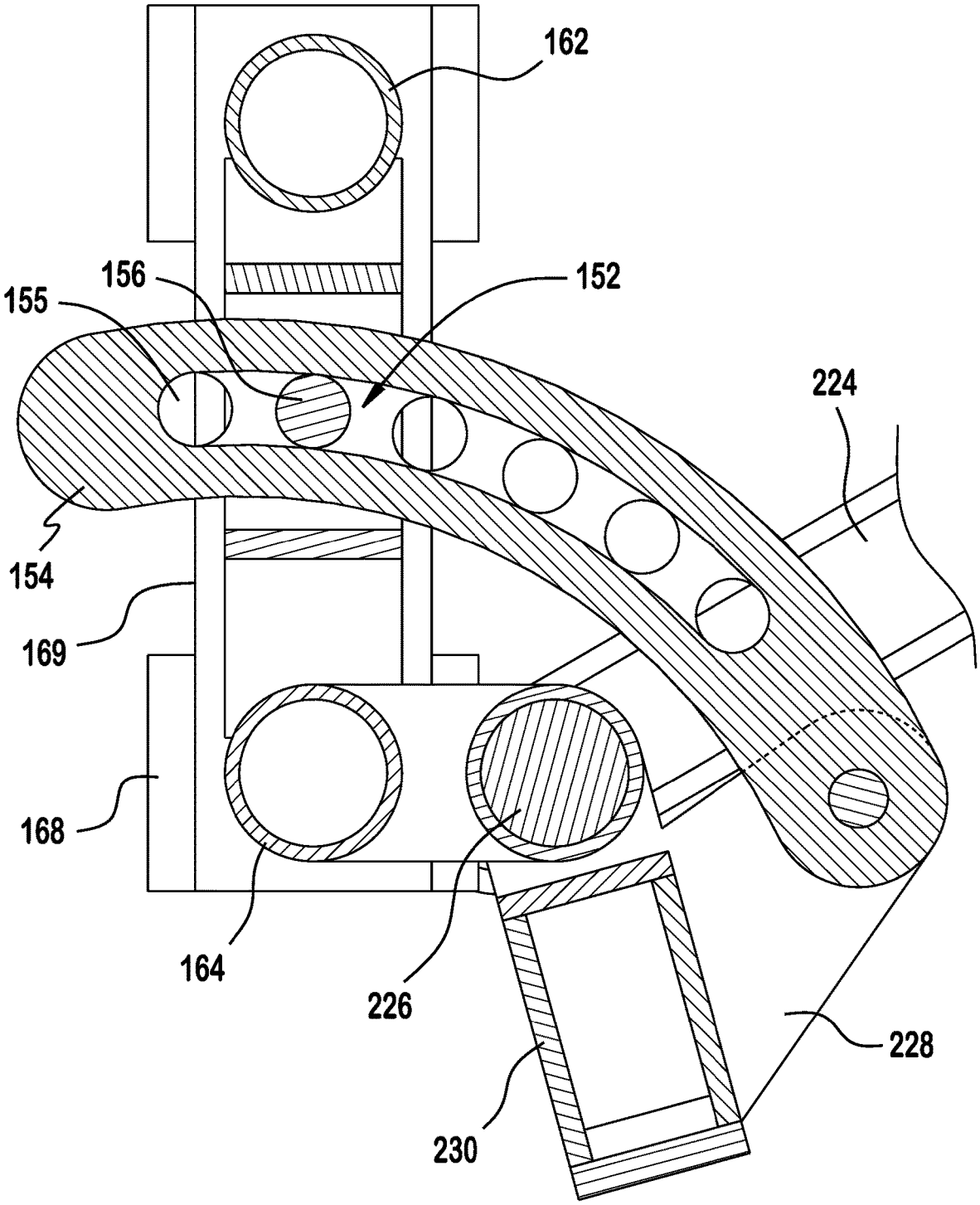
FIG. 17 is a cross-sectional view of the mounting assembly 122 taken through the rounded bar 154 and illustrating the engagement of the pin 156 with one of the holes 155. Upper and lower horizontal bars 162, 164 may, but are not necessarily, hollow.
Figure 18:
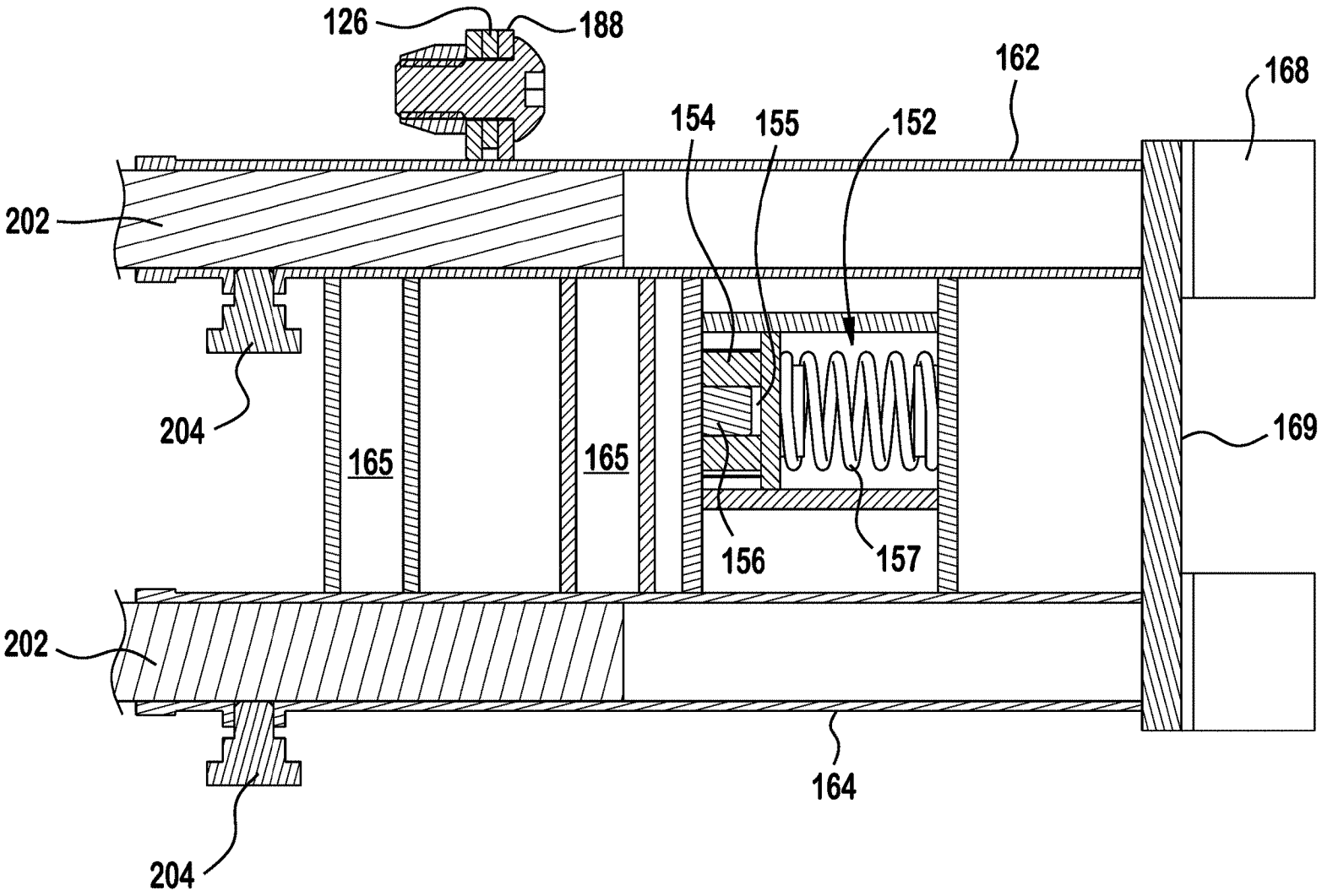
FIG. 18 is a cross-sectional view taken between a single H-frame 160 illustrating the upper and lower horizontal bars 162, 164 each with a portion of a telescoping attachment 202 located therein. Locking mechanisms 204 are used to secure the relative position of the telescoping attachment 202 to the upper and lower horizontal bars 162, 164. The telescoping attachments 202 may be entirely withdrawn into the upper and lower horizontal bars 162, 164 if there is no desire to connect to adjacent H-frame members 160. While two vertical cross beams 165 are shown connecting the upper and lower horizontal bars 162, 164, those of ordinary skill in the art will appreciate from this disclosure that any number of vertical cross beams 165 can be used (or the vertical cross beams 165 can be omitted altogether) without departing from the scope of the present invention.

Referring now to FIGS. 17 and 18, the plate elastic member 157 may provide a restorative force to the lever 158 and the rounded bar 154. After the user of the wheelchair has disengaged the rounded bar 154 from the pin 156 and rotated the leg support post 108 to the desired height, the user of the wheelchair no longer has to exert any force or work on the lever and the restorative force of the plate elastic member 157 may reengage the rounded bar 154 with the pin 156 and lock the leg support post 108 into position. The restorative force of the plate elastic member 157 may also return the lever 158 to a position closer to the user of the wheelchair. The vertical cross beams 165 separating the upper horizontal bar 162 from the lower horizontal bar 164 may be of any length sufficient to provide space in between the upper and lower horizontal bars 162, 164 for the pin lock mechanism 152 and other various components of the mounting assembly 122. One of ordinary skill in the art would appreciate from this disclosure that any number of vertical cross beams 165 may be employed (as well as omitting vertical cross beams 165 altogether) without departing from the scope of the present invention. The bracket plate 169 may also comprise various lengths as required by the separation distance between the upper and lower bars 162, 164.

Figure 19:
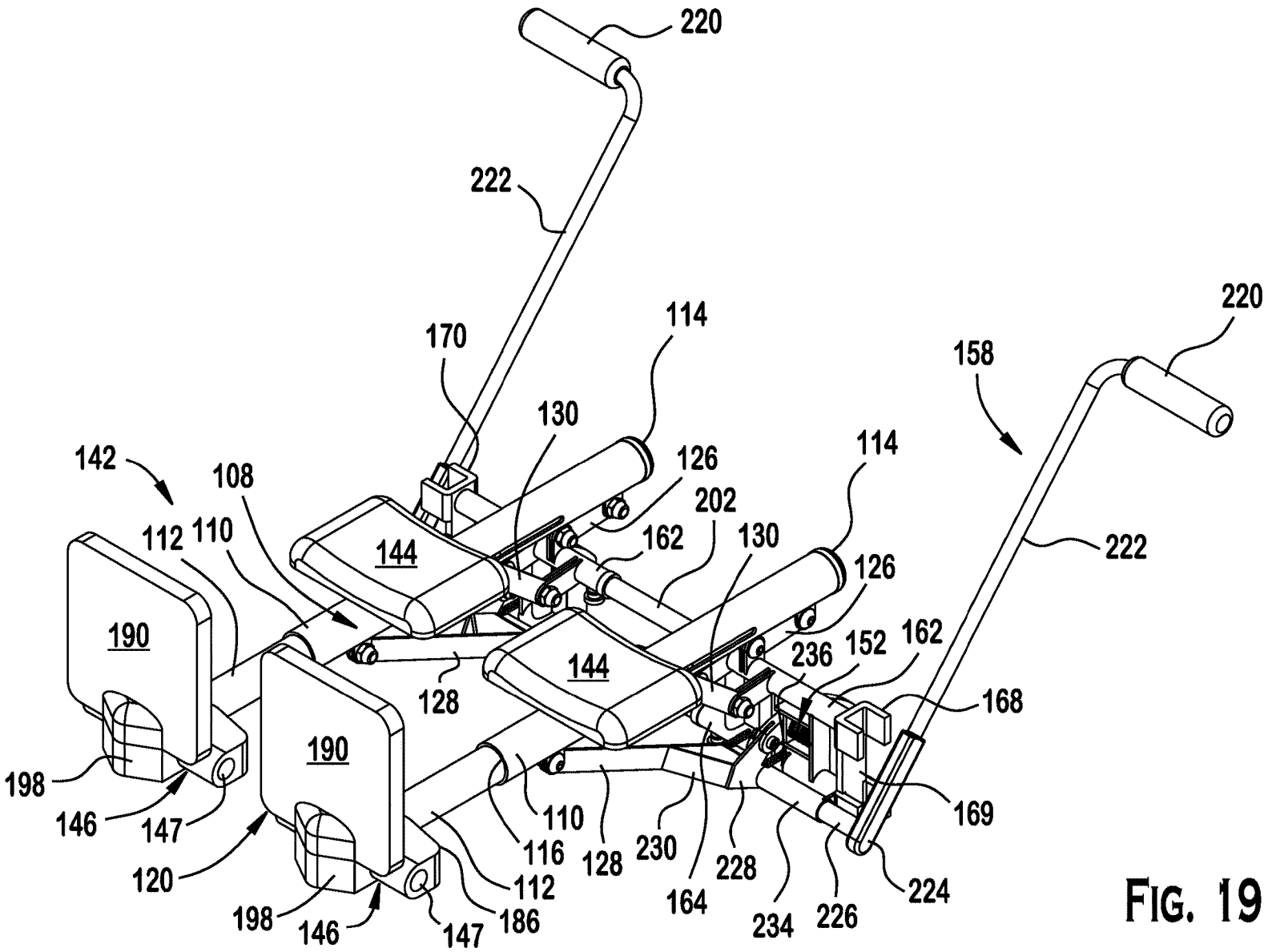
FIG. 19 is a top perspective view of the mounting assembly 122 with the leg supports 108 each extended laterally outwardly in a position that would be used by a user to hold his legs generally straight in front of the wheelchair 102. This configuration is also referred to as the second, extended position 142. In this position the third linkage 130 is engaged with a pin 206 in the slot 132 and the outer tube 110 is preferably driven toward the distal outer tube end 116. Also illustrated is the way that the outer tubes 110 are symmetrically underlying the calf cushions 144 such that a user's legs are being completely supported with the outer tubes 110 lying underneath. This eliminates the weight of the legs causing a rotational or twisting force to be exerted on the outer tubes 110.

Referring now to FIG. 19 of the preferred embodiment, the leg assembly 100 can be seen in the second, extended position 142. In the second, extended position 142, the levers 158 may extend behind the mounting assembly 122. The levers 158 may comprise a handle 220 located at a distal end in order to provide an easy place for the user of the wheelchair to grasp and adjust the leg support posts 108 to a desired height. The lever 158 may further comprise a torque bar 222 between the handle 220 and a lever elbow 224. The torque bar 222 assists the user in transferring the force exerted by the user on the handle 220 toward the pin lock mechanism 152, the rounded bar 154, and the leg support post 108. The lever elbow 224 is the connection point between the torque bar 222 and the lateral adjustment bar 226 which may provide the rotational and lateral force required by the leg assembly 100 to operate. The lateral adjustment bar 226 may extend from the lever elbow 224 through a sleeve 234 affixed to the lower horizontal bar 164 via sleeve brackets 236. The lateral adjustment bar 226 is preferably free to rotate and slide through the sleeve 234 and the lateral adjustment bar 226 connects at an end distal from the lever elbow 224 to a bar support plate 228. The bar support plate 228 connects and facilitates the transfer of motion and work from the lever 158 to the rounded bar 154 through the pin lock mechanism 152. The bar support plate 228 also connects the rounded bar 154 and the lever 158 to a synchronizing link bar 230. The synchronizing link bar 230 may connect the bar support plate 228 to the second linkage 128 in order to provide additional lift assistance to the leg support post 108 when the lever 158 is engaged by the user to raise or lower the leg support posts 108.

Figure 20:
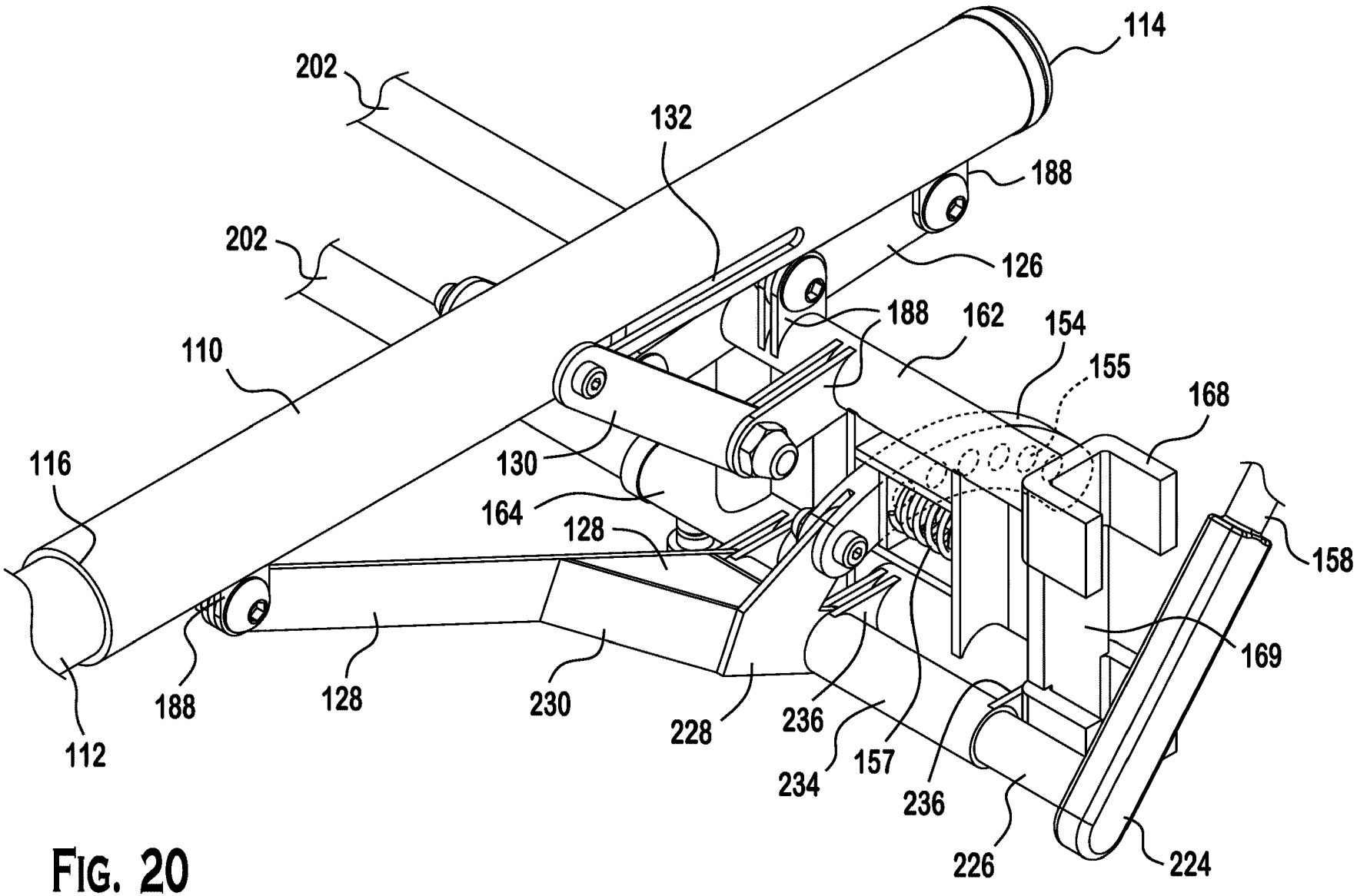
FIG. 20 is a partial, broken away, perspective view of the mounting assembly 122 in the configuration shown in FIG. 19. Specifically, the outer tube 110 has been rotated maximally upwardly such that the users leg is generally straight and the third linkage 130 has an third linkage tube end 134 that is almost entirely secured at the left end of slot 132. In this position, the first linkage 126 extends generally rearwardly from the H-frame 160.
Figure 21:
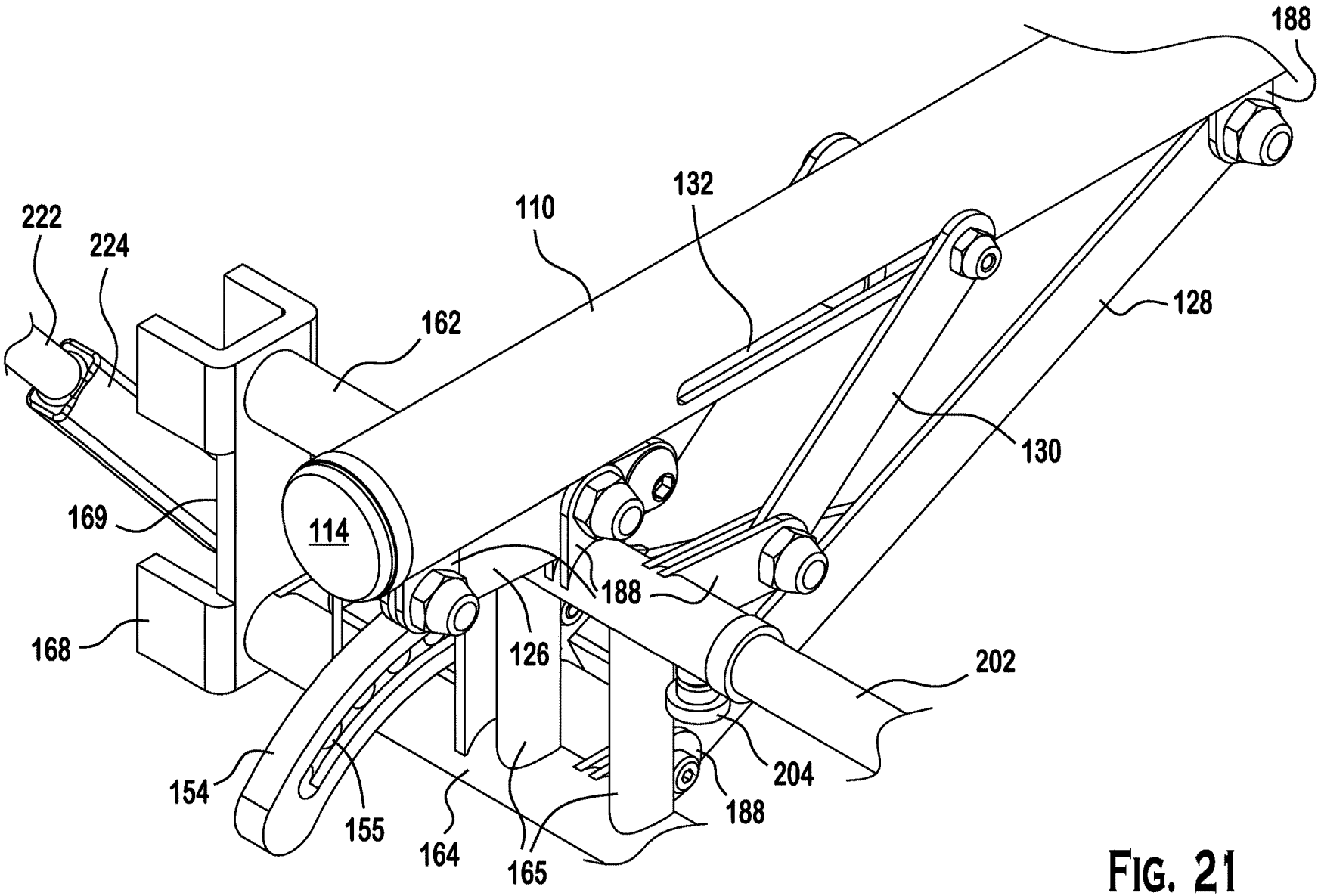
FIG. 21 is a view similar to that of FIG. 20 from a rear, perspective point of view. The proximal outer tube end 114 of the outer tube 110 is positioned rearwardly of the upper horizontal bar 162. This is different from its position in front of the upper horizontal bar 162 when the outer tube 110 is positioned generally vertically so that a user can use the foot rest 120 while in a seated position with legs bent. The outer tube 110 does not pivot about the proximal outer tube end 114 of the outer tube 110 rotating around the H-frame 160. Instead, the outer tube 110 rotates so that the proximal outer tube end 114 thereof moves through an arcuate path 180.

Referring now to FIGS. 20 and 21 of the preferred embodiment of the present invention, the slot 132 in the outer tube 110 may exist on two opposite sides of the outer tube 110. Thereby, the slot 132 may allow a pin 206 to extend horizontally across a diameter of the outer tube 110. In the preferred embodiment, there may be two third linkages 130 which extend to opposite sides of the outer tube 110 parallel to one another. The corresponding third linkage outer tube ends 134 may have a pin 206 extending therebetween, the pin 206 affixing the two third linkages 130 through the slot 132. In this way, the two third linkages 130 provide more stability and rigidity to the locked-in position of the leg support post 108. The two third linkages 130 may also allow for an increase in weight capacity, such as that provided by a bariatric wheelchair, by utilizing both third linkages 130 to redistribute tensile force to and reinforce the existing strength of the mounting assembly 122. Those of ordinary skill in the art would appreciate from this disclosure that one, two, or three third linkages 130 may be employed to engage the pin 206 and drive the inner tube 112 outwardly via the slot 132 without departing from the scope of the present invention.

Figure 22:
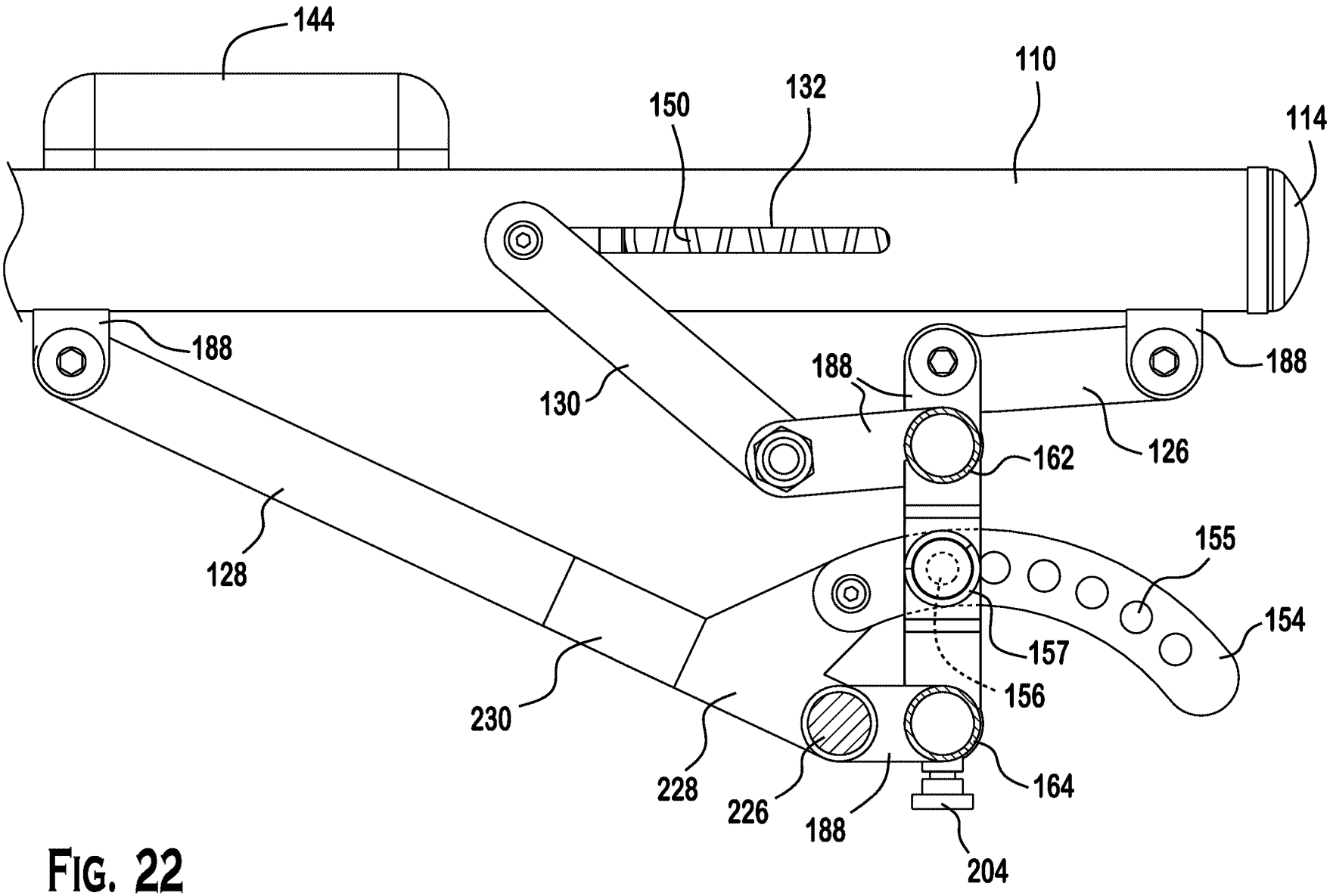
FIG. 22 is a side, cross-sectional view of the mounting assembly 122 with the leg support 108 fully extended outwardly. In this view, an elastic member 150 can be seen through the slot 132. The elastic member 150 is inside the outer tube 110 and is located between the proximal outer tube end 114 and a block to which the third linkage tube end 134 is pinned. This results in the elastic member 150 providing a lift assistance force to a user who may be moving the leg support 108 into the second, extended position 142. By calibrating the strength and size of the elastic member 150 a user with limited strength and mobility can still move the leg support post 108 and their leg into the extended position due to the calibration of the elastic member 150 taking into account the weight of the leg support 108 and the weight of the users leg. This may provide a purely mechanical lift assistance that can be tailored to the individual user.
Figure 23:
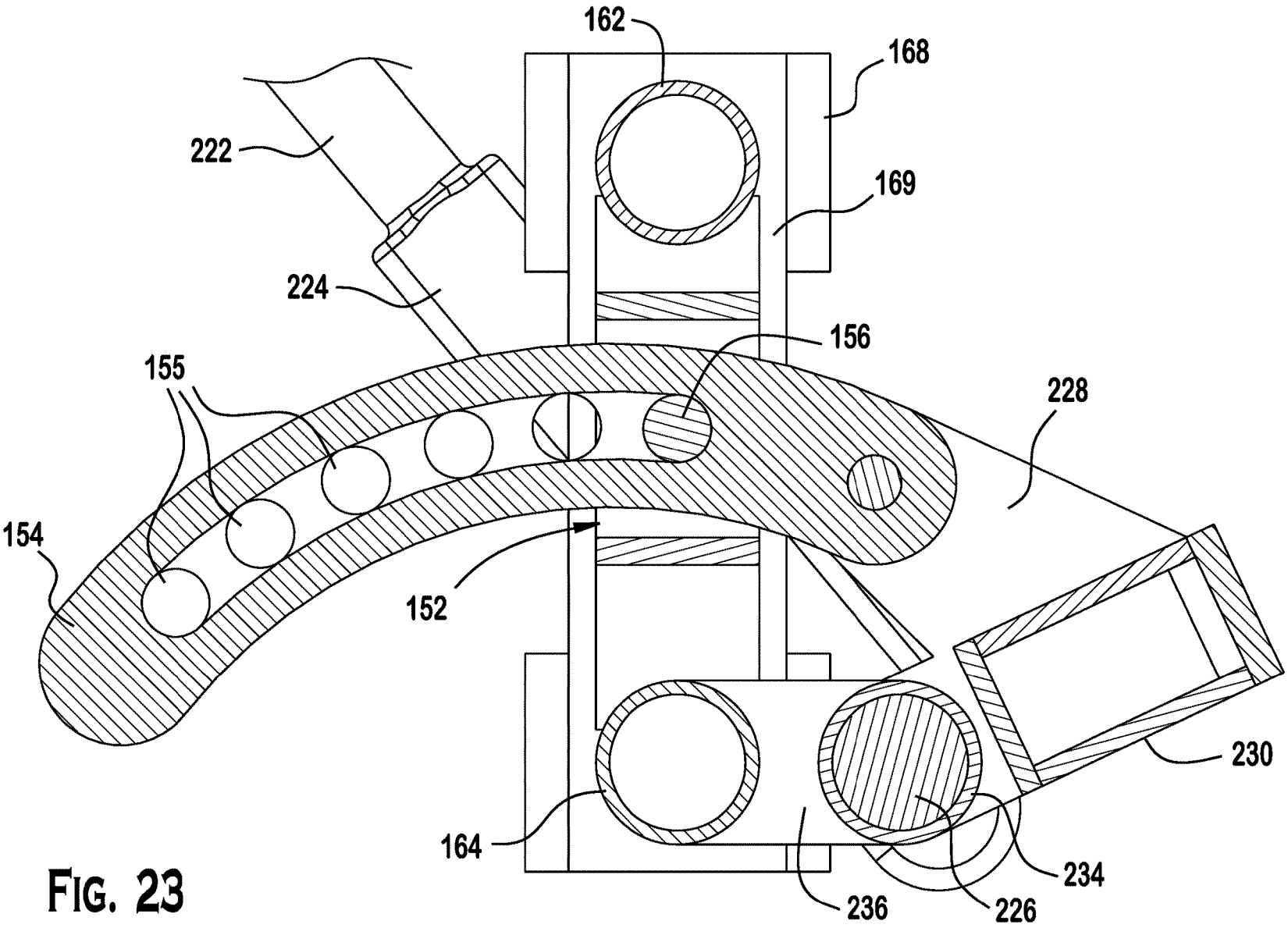
FIG. 23 a partial, cross-sectional, broken away view of the mounting assembly 122 as taken through the rounded bar 154 illustrating the relative position of the rounded bar 154, the bar support plate 228, the synchronizing link bar 230, and the H-frame 160 when the leg support 108 is the second, extended position 142.

Referring now to FIGS. 22 and 23 of the preferred embodiment of the present invention, the leg support post 108 can be seen in the second, extended position 142. The first linkage 126 may be extend entirely behind the mounting assembly 122 when the leg support post 108 is in the second, extended position 142. In the second, extended position 142, the only components of the leg assembly 100 extending vertically under the mounting assembly may be the lock mechanisms 204. None of the plurality of holes 155 may be located in front of the mounting assembly 122 when the leg support post 108 is in the second, extended position 142. The slot 132 disposed along the outer tube 110 may be lined with friction resistant material in order to reduce or eliminate wear and tear of the pin 206 and the slot 132 as the components move against one another.

Figure 24:
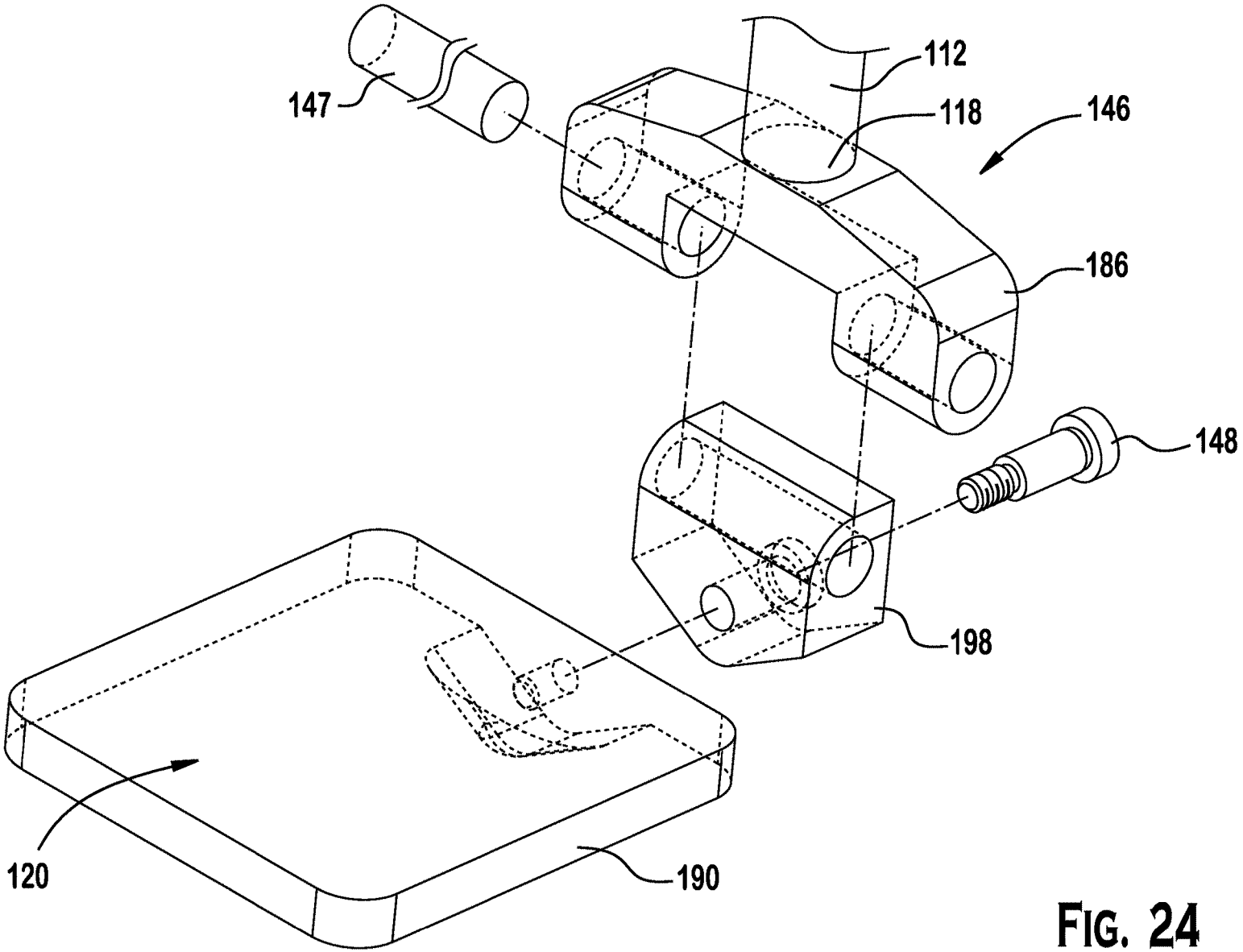
FIG. 24 is an exploded view of the foot rest 120 and the joint 146 illustrating the mating hinge 186 which is secured to a hinge 198 via a pin/first bolt 147. A pin/second bolt 148 is used to secure the footplate 190 to the hinge 198. It is preferably possible to secure the footplate 190 in any rotated position about the longitudinal axis of the inner tube 112 as well as to clamp the footplate 190 relative to the axis of the inner tube 112 or the longitudinal axis of the second bolt 148. This preferably allows a user's foot to be comfortably supported regardless of disfigurement.

Referring now to FIG. 24 of the preferred embodiment of the present invention, the joint 146 may be canted, rotated, swiveled, or otherwise flexibly adjusted to aid in the comfort of the foot of the user. While the mating hinge 186, the hinge 198, and the foot plate 190 are intended to be connected via rotatable first and second bolts/pins 147, 148, those of ordinary skill in the art would appreciate from this disclosure that that any of these components may be constructed in a manner which renders them permanently connected, in existence as one solid piece, or otherwise affixed to one another without departing from the scope of the present invention. Although the mating hinge 186, the hinge 198, and the foot plate 190 are intended to move relative to one another, those of ordinary skill in the art would appreciate that they may be static if desired without departing from the scope of the present invention. Additionally, the joint 146 may comprise a universal joint or any other suitable flexible and rotatable means of attaching two or more components without departing from the scope of the present invention. Those of ordinary skill in the art would appreciate from this disclosure that the foot plate 190 may be open and multi-positional to allow for support of and adaptation to any type of skin contact surfaces of the user, without departing from the scope of the present invention.

Figure 25:
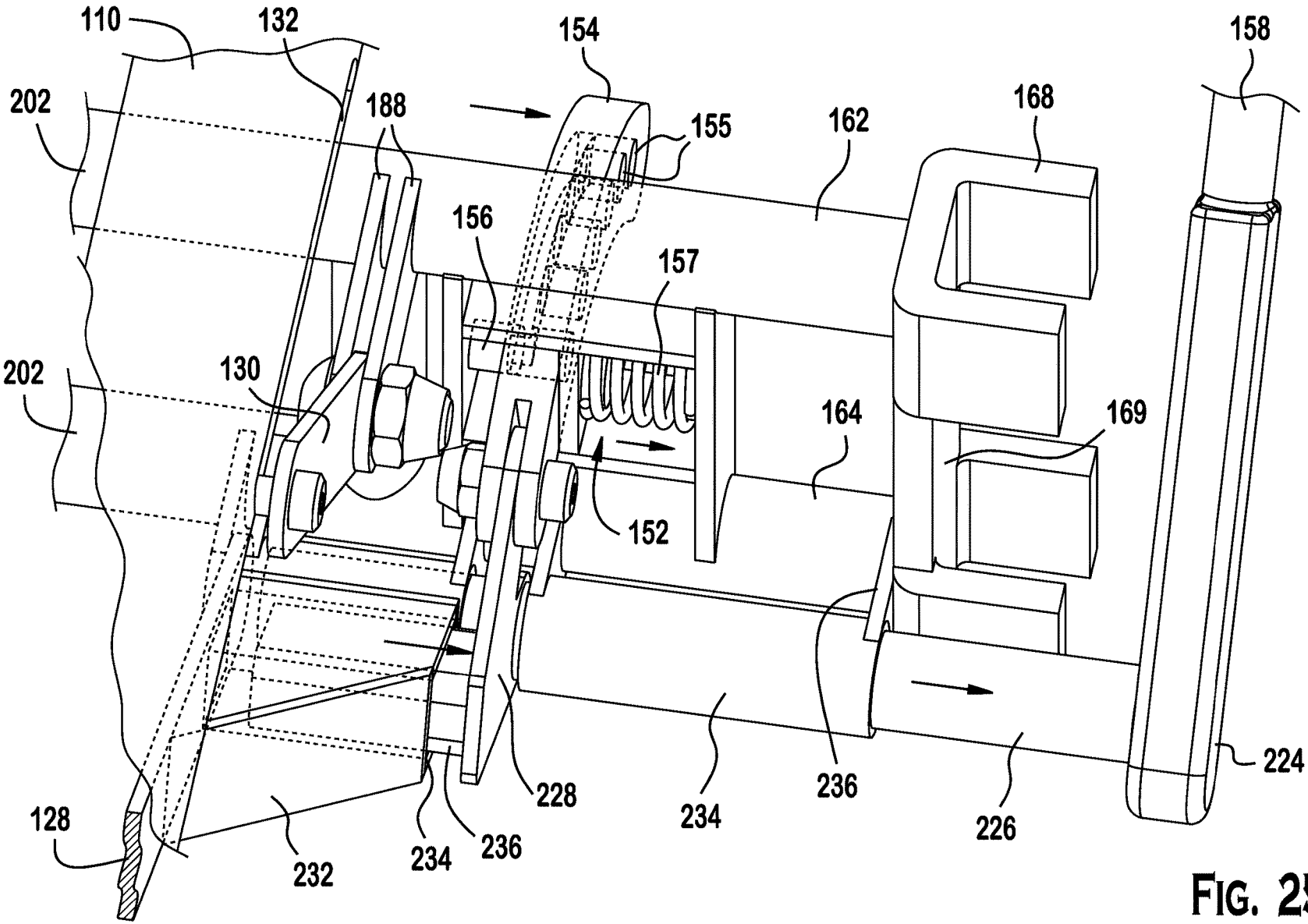
FIG. 25 is an a partial, broken away, perspective view of the pin lock mechanism 152. In this preferred alternative embodiment of the present invention, a synchronizing link box 232 may be used instead of the synchronizing link bar 230. The synchronizing link box 232 is shown with a link box engagement hole 234 configured to engage with a link box engagement pin 236. The link box engagement pin 236 protrudes from the bar support plate 228 and is configured to be able to slide into and out of the link box engagement hole 234. The link box engagement pin 236 slides out of the link box engagement hole 234 when the lever 158 is engaged to adjust the leg assembly 100.

Referring now to FIG. 25 of the alternative preferred embodiment of the present invention, the pin lock mechanism 152 may be seen. A synchronizing link box 232 may be substituted for the synchronizing link bar 230. Those of ordinary skill in the art would appreciate from this disclosure that the synchronizing link box 232 may be substituted for the synchronizing link bar 230 without departing from the scope of the present invention. The synchronizing link box 232 may be configured to include a link box engagement hole 234. The link box engagement hole 234 may approximate any rectangular shape. A link box engagement pin 236 may protrude from the bar support plate 228 that corresponds to the link box engagement hole 234. The link box engagement pin 236 may be configured to slide into and out of the link box engagement hole 234. This engagement of the hole 234 and the pin 236 may allow for the lever 158 directly provide a lift assistance and a rotational force to the leg support post 108 while also allowing the lever 158 to move along a horizontal axis parallel to the lower horizontal bar 164. This horizontal movement may allow for the pin lock mechanism 152 to be disengaged for the entire leg assembly 100 to be adjusted.

Figure 26:
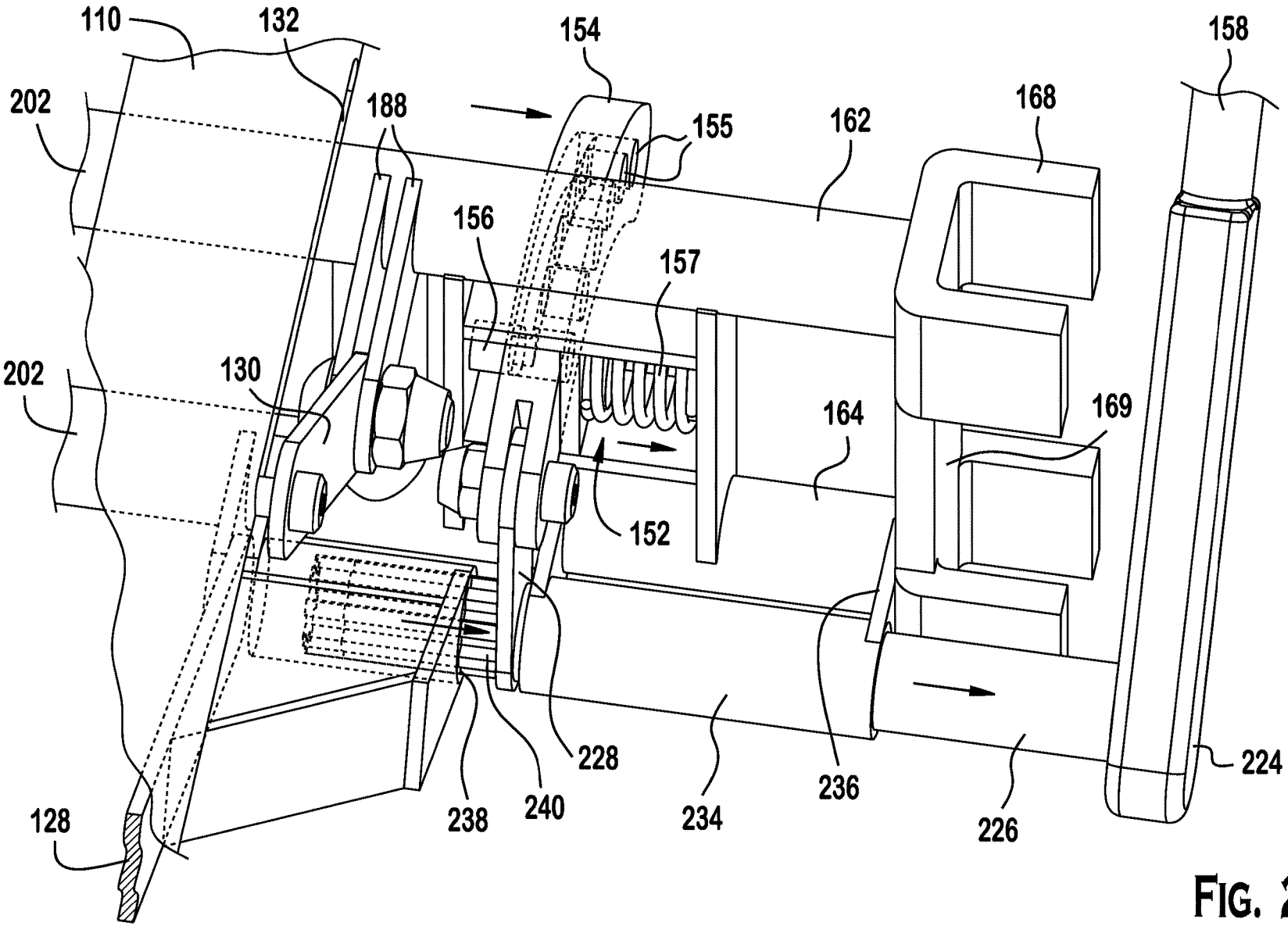
FIG. 26 is an a partial, broken away, perspective view of the pin lock mechanism 152. In this preferred embodiment of the present invention, a synchronizing link box 232 may be used instead of the synchronizing link bar 230. The synchronizing link box 232 is shown with a link box spline hole 238 configured to engage with a link box spline pin 240. The link box spline pin 240 protrudes from the bar support plate 228 and is configured to be able to slide into and out of the link box spline hole 238. The link box spline pin 240 slides out of the link box spline hole 238 when the lever 158 is engaged to adjust the leg assembly 100. The link box spline pin 240 and link box spline hole 238 have corresponding splines to increase surface contact between the components and allow for a greater transfer of rotational force between the components. It is preferable, but not necessary, that the fit between spline hole 238 and the link box spline pin 240 is loose. The complete removal of the pin 240 form the hole 238 can be, but is not necessarily, accomplished by a washer attached to the pin 240 or by limiting the amount of lateral motion that is possible by the rounded bar 154.

Referring now to FIG. 26 of the preferred embodiment of the present invention, the pin lock mechanism 152 may be seen. A synchronizing link box 232 may be substituted for the synchronizing link bar 230. Those of ordinary skill in the art would appreciate from this disclosure that the synchronizing link box 232 may be substituted for the synchronizing link bar 230 without departing from the scope of the present invention. The synchronizing link box 232 may be configured to include a link box spline hole 238. The link box spline hole 238 may approximate any gear-like, splined shape. A link box spline pin 240 may protrude from the bar support plate 228 that corresponds to the link box spline hole 238. The link box spline pin 240 may be configured to slide into and out of the link box spline hole 238. This engagement of the hole 238 and the pin 240 may allow for the lever 158 directly provide a lift assistance and a rotational force to the leg support post 108 while also allowing the lever 158 to move along a horizontal axis parallel to the lower horizontal bar 164. This horizontal movement may allow for the pin lock mechanism 152 to be disengaged for the entire leg assembly 100 to be adjusted. Those of ordinary skill in the art would appreciate that the link box spline pin 240 may be configured as one distal end of the lateral adjustment bar 226 as well as protruding from the bar support plate 228 without departing from the scope of the present invention.

Figure 27:
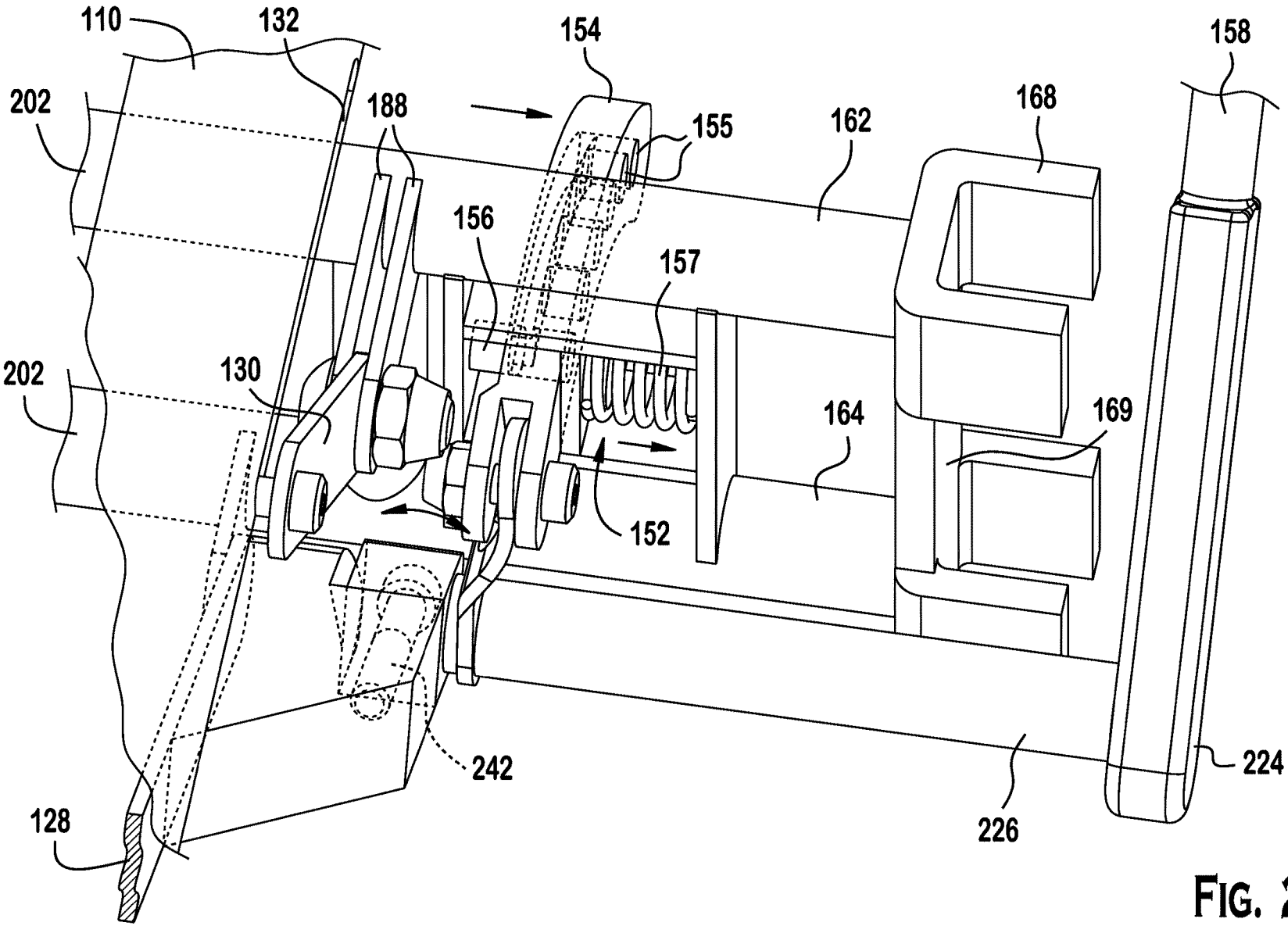
FIG. 27 is an a partial, broken away, perspective view of the pin lock mechanism 152. In this alternative preferred embodiment of the present invention, a synchronizing link box 232 may be used instead of the synchronizing link bar 230. The synchronizing link box 232 includes a lever adjustment pin 242. The lever 158 connects to the lever adjustment pin 242 at one distal end of the lateral adjustment bar 226. The lever adjustment pin 242 allows for the flexibility of the lever 158 where the later adjustment bar forms an acute angle with the lower horizontal bar 164.

Referring now to FIG. 27 of the preferred embodiment of the present invention, the pin lock mechanism 152 may be seen. A synchronizing link box 232 may be used instead of the synchronizing link bar 230. The synchronizing link box 232 may include a lever adjustment pin 242. The lever 158 may connect to the lever adjustment pin 242 at one distal end of the lateral adjustment bar 226. The lever adjustment pin 242 may allow for the flexibility of the lever 158 where the lateral adjustment bar forms an acute angle with the lower horizontal bar 164. This flexibility and ability to form an angle may allow the lever 158 to connect to the leg support post 108 without the use of slidingly contacting components.

Referring generally to FIGS. 1-27 of the preferred embodiment, it may advantageous that the various joints, connections, levers, elastic members, and other devices employed in construction make use of various geometries to not only reduce the manual power required to rotate the leg support post 108, but to eliminate the need for any electrical components, motors, and other non-manual powered devices that may typically be desirable for users of a wheelchair 102. Those of ordinary skill in the art would appreciate from this disclosure that many other manual powered components may be employed to reduce total work required to operate the leg support post rotation as well as that which may be required by the size and shape of different types of wheelchairs with departing from the scope of this disclosure. Alternatively, the leg assembly 100 may incorporate motors or other electrical components without departing from the scope of the present invention. Those of ordinary skill in the art would appreciate from this disclosure that the leg assembly 100 is universal and may be configured to be used with any type of wheelchair, chair, couch, stool, bench, or any other type of seating device, without departing from the scope of the present invention.

It is recognized by those skilled in the art that changes may be made to the above described methods and structures without departing from the broad inventive concept thereof. It is understood, therefore, that this invention is not limited to the particular embodiments disclosed, but is intended to cover all modifications which are within the spirit and scope of the invention as defined by the above specification, the appended claims and/or shown in the attached drawings.

What is claimed is:

1. A leg assembly configured for use with a wheelchair having first and second wheel support beams, the leg assembly comprising:

a leg support post, comprising:

an outer tube having a proximal outer tube end and a distal outer tube end;

an inner tube being configured to slide within the outer tube and having a distal inner tube end, the inner tube protruding from the distal outer tube end such that the distal inner tube end is not contained within the outer tube; and a foot rest secured to the inner tube proximate the distal inner tube end;

a mounting assembly configured to be attachable to one of the first and second wheel support beams of the wheel chair;

wherein the leg support post is connected to the mounting assembly such that the leg support can be rotated therearound between a first, retracted position in which the wheelchair user's leg is meant to be supported in a bent position and a second, extended position in which the wheelchair user's leg is meant to be supported in a less bent position, the mounting assembly being configured such that when the leg support post is moved from the first, retracted position toward the second, extended position the inner tube slides within the outer tube such that the distal inner tube end moves further away from the distal outer tube end, when the leg support post is moved from the first, retracted position toward the second, extended position the leg support post does not pivot about the proximal outer tube end which results in the proximal outer tube end moving through an arcuate path about the mounting assembly.

2. The leg assembly of claim 1, wherein the mounting assembly is configured such that when connected to the wheelchair, the mounting assembly is located under a seat thereof and between the first and second wheel support beams.

3. The leg assembly of claim 2, wherein the leg support post is connected to the mounting assembly via a first linkage and a second linkage, the first linkage and the second linkage engaging the mounting assembly at a different height when the mounting assembly is attached to the wheelchair.

4. The leg assembly of claim 3, wherein the leg support post is also connected to the mounting assembly via a third linkage, the third linkage engaging the mounting assembly at a different height from the first linkage and the second linkage when the mounting assembly is attached to the wheelchair.

5. The leg assembly of claim 4, wherein the first linkage and the second linkage extend between the outer tube and the mounting assembly.

6. The leg assembly of claim 5, wherein the outer tube defines a slot therein, the third linkage having a third linkage tube end and a third linkage frame end, the third linkage tube end being secured to a portion of the inner tube accessible via the slot such that the third linkage tube end and the inner tube can move relative to the outer tube, the third linkage frame end being connected to the mounting assembly.

7. The leg assembly of claim 6, wherein the first linkage, the second linkage, and the third linkage are configured such that when the leg support post is moved from the first, retracted position toward the second, extended position the third linkage drives the inner tube outwardly away from the outer tube.

8. The leg assembly of claim 7, further comprising a calf cushion disposed on the outer tube such that the wheelchair user's leg is aligned over the leg support post while resting on the calf cushion, the foot rest being adjustably positioned via a joint proximate the distal inner tube end to allow an angle and a cant of the foot rest to be adjusted relative to the leg support post.

9. The leg assembly of claim 8, wherein the leg support post is configured to provide a biasing force between the outer tube and the inner tube to provide a lift assistance to the wheelchair user when moving the leg support post from the first, retracted position toward the second, extended position.

10. The leg assembly of claim 9, further comprising an elastic member disposed within the outer tube and positioned between the outer tube and the inner tube, wherein the elastic member provides the biasing force onto the inner tube.

11. The leg assembly of claim 10, wherein the position of the leg support post relative to the mounting assembly is detachably fixed via a pin lock mechanism.

12. The leg assembly of claim 11, wherein the pin lock mechanism comprises a rounded bar having a plurality of holes and a pin fixed to the pin lock mechanism, one of the plurality of holes of the round bar being biased into engagement with the pin by a plate elastic member extending opposite the pin, the position in which the leg support post is secured relative to the mounting assembly depending on which of the plurality of holes the pin engages.

13. The leg assembly of claim 12, further comprising a lever for manually disengaging the rounded bar from the pin against the plate elastic member and assisting in moving the leg support post.

14. The leg assembly of claim 13, wherein the leg assembly is mechanical and free of electrical components, motors, and non-manual powered devices which are used to move the leg support post.

15. A combination wheelchair and leg assembly, comprising:

a wheelchair having first and second wheel support beams; and a leg assembly, comprising:

a leg support post, comprising:

an outer tube having a proximal outer tube end and a distal outer tube end;

an inner tube being configured to slide within the outer tube and having a distal inner tube end, the inner tube protruding from the distal outer tube end such that the distal inner tube end is not contained within the outer tube; and a foot rest secured to the inner tube proximate the distal inner tube end;

a mounting assembly configured to be attachable to one of the first and second wheel support beams of the wheel chair;

wherein the leg support post is connected to the mounting assembly such that the leg support can be rotated therearound between a first, retracted position in which the wheelchair user's leg is meant to be supported in a bent position and a second, extended position in which the wheelchair user's leg is meant to be supported in a less bent position, the mounting assembly being configured such that when the leg support post is moved from the first, retracted position toward the second, extended position the inner tube slides within the outer tube such that the distal inner tube end moves further away from the distal outer tube end, when the leg support post is moved from the first, retracted position toward the second, extended position the leg support post does not pivot about the proximal outer tube end which results in the proximal outer tube end moving through an arcuate path about the mounting assembly.

16. The combination wheelchair and leg assembly of claim 15, wherein the leg support post is connected to the mounting assembly via a first linkage and a second linkage, the first linkage and the second linkage engaging the mounting assembly at a different height when the mounting assembly is attached to the wheelchair; and wherein the leg support post is also connected to the mounting assembly via a third linkage, the third linkage engaging the mounting assembly at a different height from the first linkage and the second linkage when the mounting assembly is attached to the wheelchair, the first linkage and the second linkage extending between the outer tube and the mounting assembly.

17. The combination wheelchair and leg assembly of claim 16, wherein the outer tube defines a slot therein, the third linkage having a third linkage tube end and a third linkage frame end, the third linkage tube end being secured to a portion of the inner tube accessible via the slot such that the third linkage tube end and the inner tube can move relative to the outer tube, the third linkage frame end being connected to the mounting assembly; and wherein the first linkage, the second linkage, and the third linkage are configured such that when the leg support post is moved from the first, retracted position toward the second, extended position the third linkage drives the inner tube outwardly away from the outer tube.

18. The combination wheelchair and leg assembly of claim 17, further comprising a calf cushion disposed on the outer tube such that the wheelchair user's leg is aligned over the leg support post while resting on the calf cushion, the foot rest being adjustably positioned via a joint proximate the distal inner tube end to allow an angle and a cant of the foot rest to be adjusted relative to the leg support post.

19. The combination wheelchair and leg assembly of claim 18, wherein the leg support post is configured to provide a biasing force between the outer tube and the inner tube to provide a lift assistance to the wheelchair user when moving the leg support post from the first, retracted position toward the second, extended position; and further comprising an elastic member disposed within the outer tube and positioned between the outer tube and the inner tube, wherein the elastic member provides the biasing force onto the inner tube.

20. The combination wheelchair and leg assembly of claim 19, wherein the position of the leg support post relative to the mounting assembly is detachably fixed via a pin lock mechanism, wherein the pin lock mechanism comprises a rounded bar having a plurality of holes and a pin fixed to the pin lock mechanism, one of the plurality of holes of the round bar being biased into engagement with the pin by a plate elastic member extending opposite the pin, the position in which the leg support post is secured relative to the mounting assembly depending on which of the plurality of holes the pin engages, the pin lock mechanism further comprising a lever for manually disengaging the rounded bar from the pin against the plate elastic member and assisting in moving the leg support post.

* * * * *